US009117411B2

(12) United States Patent
Yamazaki

(10) Patent No.: US 9,117,411 B2
(45) Date of Patent: Aug. 25, 2015

(54) ELECTRO-OPTIC DEVICE, METHOD OF DRIVING ELECTRO-OPTIC DEVICE, CONTROLLER, AND ELECTRONIC APPARATUS

(75) Inventor: Katsunori Yamazaki, Matsumoto (JP)

(73) Assignee: Seiko Epson Corporation (JP)

( * ) Notice: Subject to any disclaimer, the term of this patent is extended or adjusted under 35 U.S.C. 154(b) by 420 days.

(21) Appl. No.: 12/945,015

(22) Filed: Nov. 12, 2010

(65) Prior Publication Data

US 2011/0115759 A1 May 19, 2011

(30) Foreign Application Priority Data

Nov. 13, 2009 (JP) ..... 2009-259844
Jun. 1, 2010 (JP) ..... 2010-125917

(51) Int. Cl.
*G09G 3/34* (2006.01)

(52) U.S. Cl.
CPC ..... *G09G 3/344* (2013.01); *G09G 2300/08* (2013.01); *G09G 2310/0275* (2013.01); *G09G 2310/04* (2013.01); *G09G 2310/061* (2013.01); *G09G 2320/0233* (2013.01); *G09G 2320/0257* (2013.01); *G09G 2330/021* (2013.01)

(58) Field of Classification Search
CPC ..... G09G 3/344
USPC ..... 345/107
See application file for complete search history.

(56) References Cited

U.S. PATENT DOCUMENTS

| | | | | |
|---|---|---|---|---|
| 6,762,744 | B2 * | 7/2004 | Katase | 345/107 |
| 7,812,812 | B2 * | 10/2010 | Yoshinaga et al. | 345/107 |
| 2004/0113901 | A1 * | 6/2004 | Kawahara | 345/204 |
| 2006/0055634 | A1 * | 3/2006 | Han | 345/60 |
| 2008/0037898 | A1 | 2/2008 | Nakagata et al. | |
| 2008/0238899 | A1 | 10/2008 | Yamada | |
| 2009/0046114 | A1 * | 2/2009 | Lee et al. | 345/691 |
| 2009/0237351 | A1 | 9/2009 | Kanamori et al. | |
| 2009/0309870 | A1 * | 12/2009 | Takei | 345/214 |

FOREIGN PATENT DOCUMENTS

| | | | |
|---|---|---|---|
| CN | 101123679 | A | 2/2008 |
| JP | 08-146912 | A | 6/1996 |
| JP | 2002-297092 | A | 10/2002 |
| JP | 2008-242380 | | 10/2008 |
| JP | 2009-229508 | A | 10/2009 |

* cited by examiner

*Primary Examiner* — Roy Rabindranath
(74) *Attorney, Agent, or Firm* — Harness, Dickey & Pierce, P.L.C.

(57) ABSTRACT

An electro-optic device includes a plurality of scanning lines that are arranged in a line direction, a plurality of data lines that are arranged in a column direction, a plurality of pixels that are provided at intersection positions of the scanning lines and the data lines, a driving circuit that supplies an image signal based on image data to a display unit formed by arranging the plurality of pixels, and an image data input circuit that inputs the image data to the driving circuit. The image data input circuit includes a storage unit that stores line data of a plurality of continuous lines including line data of an input target among line data formed from pixel data corresponding to one line of the image data, and from the storage unit and corrects the pixel data of the input target on the basis of information of the peripheral pixel data.

13 Claims, 20 Drawing Sheets

FIG. 9A S101
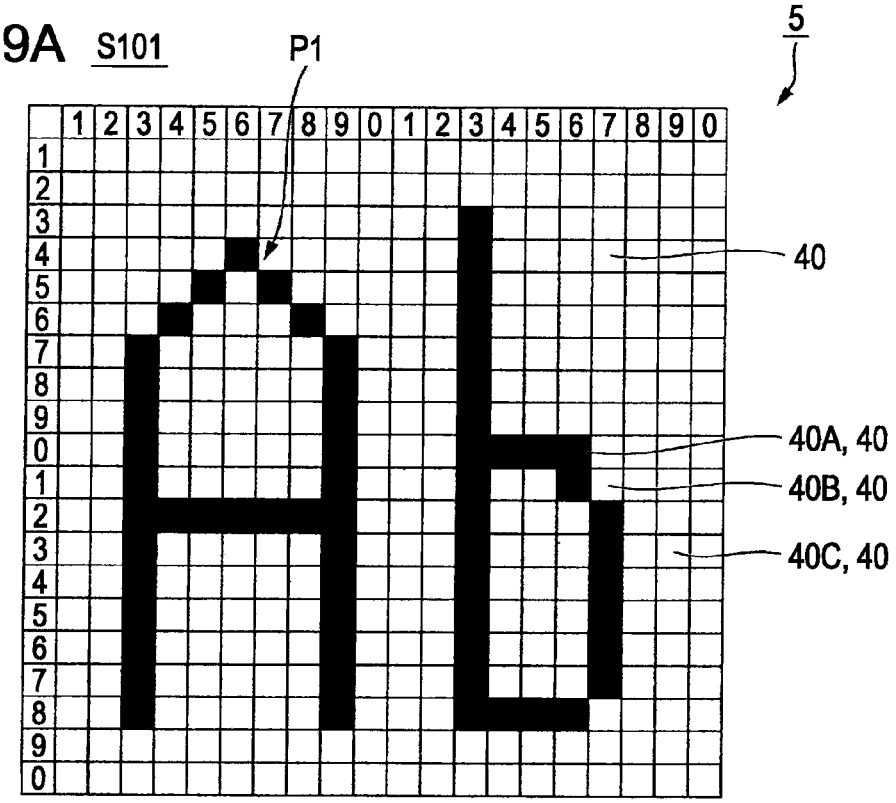
FIG. 9B S102
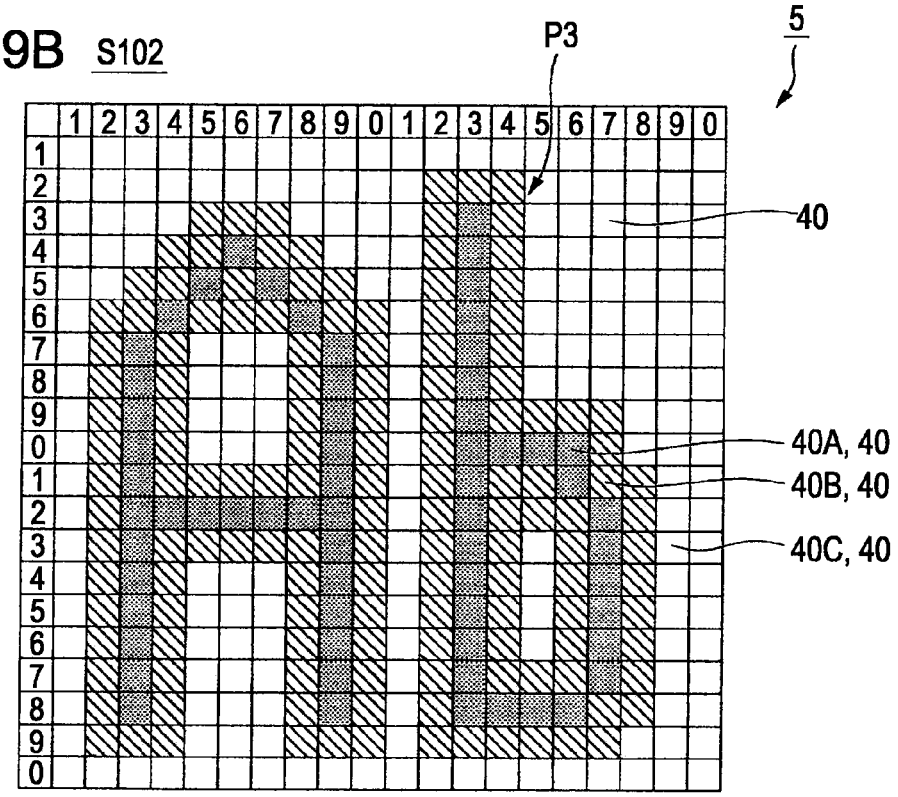

FIG. 12 S102
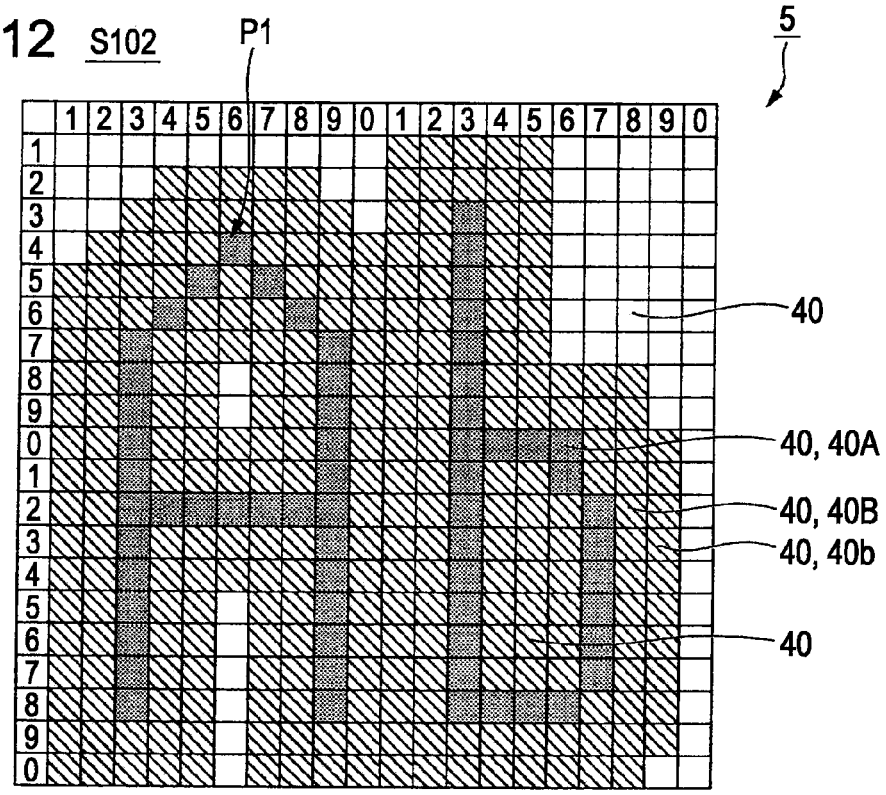
FIG. 13 S102
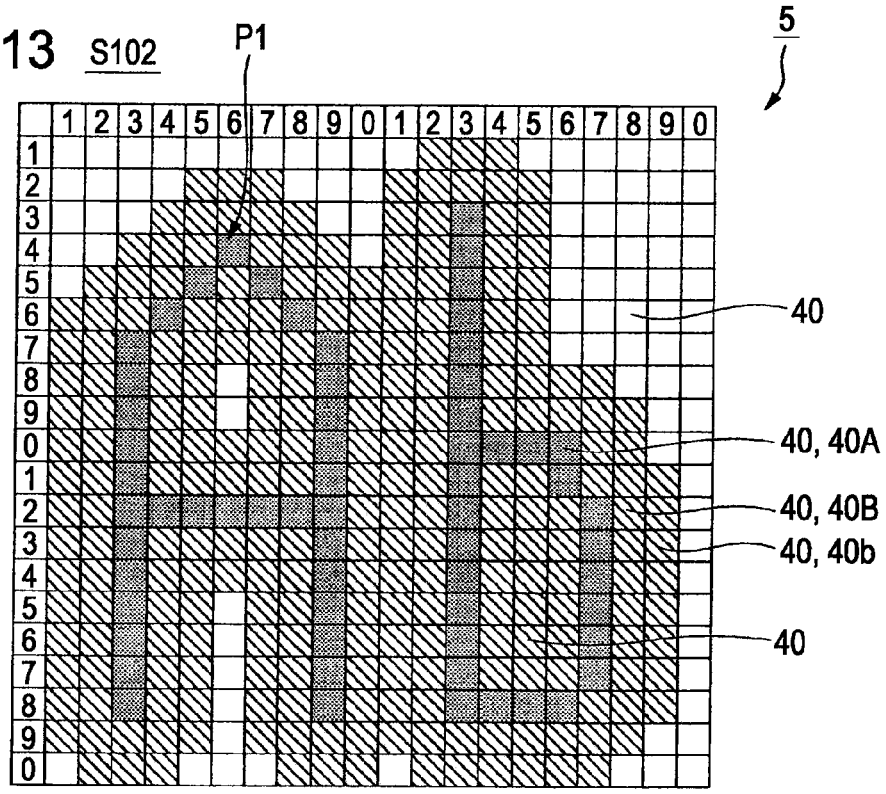

ELECTRO-OPTIC DEVICE, METHOD OF DRIVING ELECTRO-OPTIC DEVICE, CONTROLLER, AND ELECTRONIC APPARATUS

BACKGROUND

1. Technical Field

The present invention relates to an electro-optic device, a method of driving the electro-optic device, a controller, and an electronic apparatus.

2. Related Art

In electrophoretic display devices as electro-optic devices, stored display contents are erased before writing new display contents, and it is known that only pixels forming displayed image components are driven to perform image erasing as a method of efficiently erasing the display contents, and reverse erasing of temporarily displaying white color on the whole face is performed. That is, the display contents are erased by applying potential difference in a direction reverse to that of the potential difference which was applied at the displaying time (JP-A-2008-242380 is an example of related art.).

However, when the reverse erasing is performed, a problem is caused in that a slight difference occurs in the reflection ratio at a boundary between pixels in which gradation is changed and which become white and pixels (pixels originally having a white color) in which gradation is not changed, and a thin residual image occurs according to the outline of the former image. In this case, a driving method of performing erasing on pixels (pixels which do not change the gradation) around the pixels changing the gradation is conceivable in which erasing is performed so that the residual image of the former image does not remain when updating the image.

However, image data including information designating the boundary pixels has to be prepared to perform the image boundary erasing described above. Accordingly, a frame memory for operation is necessary, or the operation processing time or power consumption load of a controller and a superordinate device thereof increases.

Aside from the problem at the time of the reverse erasing, in the electrophoretic display device, there is a case where the density of display color (black) is changed when the pixels forming the displayed image components (e.g., a black display part) are isolated and when they are adjacent to each other, and thus there is a problem that display unevenness occurs.

SUMMARY

An advantage of some aspects of the invention is to provide an electro-optic device, a method of driving the electro-optic device, a controller, and an electric apparatus capable of easily realizing a function of erasing an image so as not to cause a residual image while power consumption is suppressed, and a function of removing the display unevenness.

According to an aspect of the invention, there is provided an electro-optic device including: a plurality of scanning lines that are arranged in a line direction; a plurality of data lines that are arranged in a column direction; a plurality of pixels that are provided at intersection positions of the scanning lines and the data lines; a driving circuit that supplies an image signal based on image data to a display unit formed by arranging the plurality of pixels; and an image data input circuit that inputs the image data to the driving circuit, wherein the image data input circuit includes a storage unit that stores line data of a plurality of continuous lines including line data of an input target among line data formed from pixel data corresponding to one line of the image data, and a data correcting circuit that reads the pixel data of the input target with peripheral pixel data thereof from the storage unit and corrects the pixel data of the input target on the basis of information of the peripheral pixel data.

According to the aspect of the invention, it is possible to perform the writing of the pixel data in consideration of a state of the peripheral pixels of the pixels of the input target by providing a storage unit that stores the line data of the plurality of continuous lines including the line data of the input target and the data correcting circuit that reads the pixel data of the input target with the peripheral pixel data thereof from the storage unit and corrects the pixel data of the input target on the basis of the information of the peripheral pixel data. Accordingly, since image data for erasing including an outline of an image can be formed by the data correcting circuit even when providing processed image data, it is possible to easily realize a function of erasing an image without generating a residual image. Since the pixel data can be corrected on the basis of the dispositional circumstances of the peripheral pixel data, it is possible to easily realize a function of removing display unevenness.

In the electro-optic device, it is preferable that the image data are image data for erasing a display image of the display unit, and the data correcting circuit corrects the pixel data of the input target on the basis of a result of a Boolean operation using the peripheral pixel data.

According to the aspect, since the pixel data of the input target is corrected on the basis of the result of the Boolean operation using the peripheral pixel data, it is possible to correct the pixel data input to the pixels for each condition. Since the correction of the pixel data of the input target can be performed by a simple logic circuit using the Boolean operation, it is possible to reduce a burden on a superordinate device and to shorten a processing time, and thus the device can be driven with low power consumption.

In the electro-optic device, it is preferable that the image data are image data of displaying a display image including a plurality of gradations on the display unit, and the data correcting circuit corrects gradation values of the pixel data of the input target on the basis of the arithmetic sum of the gradation values of the peripheral pixel data.

According to the aspect of the invention, the gradation value of the pixel data of the input target is corrected on the basis of the arithmetic sum of the gradation values of the peripheral pixel data, the density of display color becomes uniform, and thus it is possible to obtain a display image having no display unevenness.

According to another aspect of the invention, there is provided a method of driving an electro-optic device including a display unit formed by arranging a plurality of pixels and a driving circuit supplying an image signal based on image data to the display unit, and the method includes, when inputting image data formed from pixel data corresponding to the pixels to the driving circuit, correcting the pixel data corresponding to the pixels of an input target on the basis of information of peripheral pixel data of the pixel data in the image data; and inputting the corrected pixel data to the driving circuit.

In the method of driving the electro-optic device, it is preferable that the pixel data of the input target is reversed on the basis of the information of the peripheral pixel data of the pixel data.

According to the aspect of the invention, when the image data for erasing the display image is input to the display unit, the pixel data of the input target is reversed on the basis of the information of the peripheral pixel data. Accordingly, pixels necessary for preventing a residual image can be easily set without separately creating the whole image data, and thus it is possible to suppress power consumption.

In the method of driving the electro-optic device, it is preferable that the pixel data of the input target is corrected on the basis of a result of the Boolean operation using the peripheral pixel data.

According to the aspect of the invention, since the pixel data of the input target is corrected on the basis of the result of the Boolean operation using the peripheral pixel data, it is possible to correct the pixel data input to the pixels for each condition.

In the method of driving the electro-optic device, it is preferable that gradation values of the pixel data corresponding to the pixels of the input target are changed on the basis of gradation values of the peripheral pixel data of the pixel data.

According to the aspect of the invention, since the gradation values of the pixel data corresponding to the pixels of the input target are changed on the basis of the gradation values of the peripheral pixel data of the pixel data, the density of the display color becomes uniform, and thus it is possible to obtain a display image having no display unevenness.

In the method of driving the electro-optic device, it is preferable that, when a display operation is performed many times using the same image data, the number of writing times to the pixels of the input target is set on the basis of the information of the peripheral data.

According to the aspect of the invention, since the number of writing times to the pixels of the input target is set on the basis of the information of the peripheral data when the display operation is performed many times using the same image data, display unevenness is solved and thus it is possible to obtain a uniform image. Since writing is not performed on all pixels of the input target more than necessary, power consumption is suppressed.

In the method of driving the electro-optic device, it is preferable that the peripheral pixel data are at least pixel data disposed adjacent to the pixel data of the input target.

According to the aspect of the invention, since the peripheral pixel data are at least pixel data disposed adjacent to the pixel data of the input target, it is possible to erase an image while a residual image does not occur in the boundary of the pixels of the input target and the peripheral pixels.

According to another aspect of the invention, there is provided a controller for controlling an electro-optic device including a display unit formed by arranging a plurality of pixels and a driving circuit supplying an image signal based on image data to the display unit, wherein when inputting image data formed from pixel data corresponding to the pixels to the driving circuit, the controller corrects the pixel data corresponding to the pixels of an input target on the basis of information of peripheral pixel data of the pixel data in the image data, and inputs the corrected pixel data to the driving circuit.

According to the aspect of the invention, since the pixel data of the input target is reversed on the basis of the information of the peripheral pixel data when the image data for erasing the display image is input to the display unit, it is possible to easily set the pixels necessary for preventing a residual image without separately creating the whole image data and to suppress power consumption.

In addition, it is preferable that the controller is provided with an image data input circuit.

According to the aspect of the invention, since the controller can be integrated into one chip with a necessary circuit element by the image data input circuit, it is possible to realize space saving and to reduce costs as compared with the known configuration with a separate chip or a single product.

According to still another aspect of the invention, there is provided an electronic apparatus provided with the electro-optic device of the invention.

According to the aspect of the invention, the electronic apparatus is provided with display means having a function of erasing an image without generating a residual image or a function of displaying a high-quality image having no display unevenness.

BRIEF DESCRIPTION OF THE DRAWINGS

The invention will be described with reference to the accompanying drawings, wherein like numbers reference like elements.

FIG. 9A and FIG. 9B are diagrams illustrating a change of a display image at the time of image updating in a driving method according to the first embodiment.

FIG. 12 is a diagram illustrating erasing data input target pixels in the driving method according to the modified example 1.

FIG. 13 is a diagram illustrating erasing data input target pixels in the other driving method according to the modified example 1.

DESCRIPTION OF EXEMPLARY EMBODIMENTS

Figure 1:
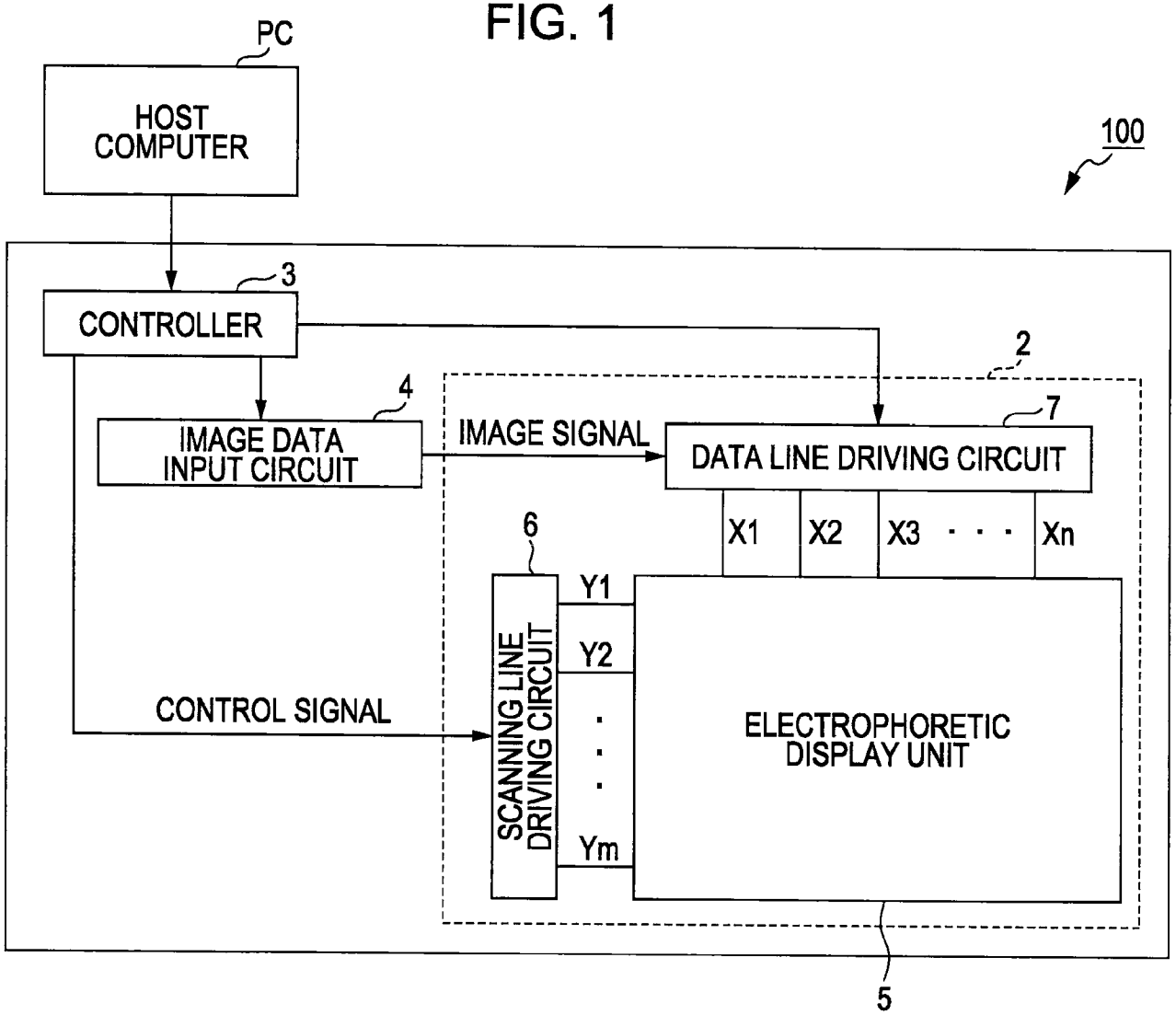
FIG. 1 is a diagram illustrating an overall configuration of an electrophoretic display device according to a first embodiment.

Hereinafter, embodiments of the invention will be described with reference to the drawings. In the drawings used for the following description, the scales of the members are appropriately changed to aid recognition of the members.

First Embodiment

FIG. 1 shows an overall configuration of an electrophoretic display device that is an electro-optic device according to an embodiment of the invention.

As shown in FIG. 1, an electrophoretic display (electro-optic device) 100 is provided with an element substrate 2, a controller 3 as control means, and an image data input circuit 4. A display unit 5, a scanning line driving circuit 6 in a peripheral area thereof, and a data line driving circuit 7 as driving means are formed on the surface of the element substrate 2. Control signals or image signals are supplied directly from the controller 3 or through the image data input circuit 4 to the scanning line driving circuit 6 and the data line driving circuit 7.

The controller 3 generally controls the electrophoretic display device 100 on the basis of image signals or synchronization signals supplied from a host computer PC as an external device. When a writing instruction of an image is input with image data from the host computer PC, the image data of the input target based on the writing instruction is output to the image data input circuit 4.

Figure 2:
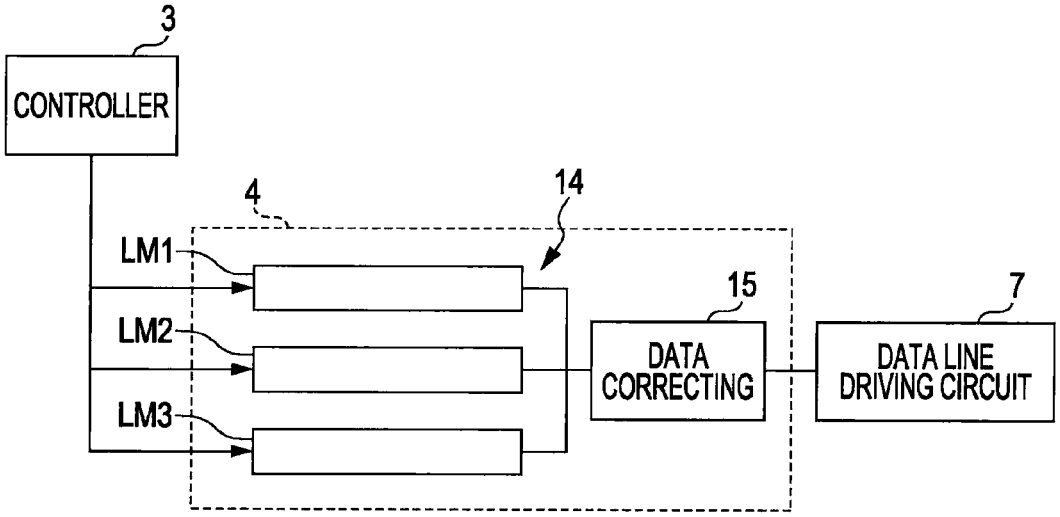
FIG. 2 is a diagram illustrating a configuration of a pixel data input circuit of the first embodiment.

FIG. 2 is a diagram illustrating a configuration of the image data input circuit.

The image data input circuit 4 is a driving circuit for inputting image data that is a group of line data formed of pixel data of one line, and is provided with a storage unit 14 having a plurality of line memories and a data correcting circuit 15.

The storage unit 14 is connected to the controller 3 and the data correcting circuit 15. The storage unit 14 has a first line memory LM1, a second line memory LM2, and a third line memory LM3, and stores a plurality of continuous line data including the line data of the input target in the line memories LM1, LM2, and LM3.

The data correcting circuit 15 is connected to the line memories LM1, LM2, and LM3 and the data line driving circuit 7, reads pixel data of the input target with peripheral pixel data thereof from the storage unit 14 (the plurality of line memories LM1 to LM3), and corrects the pixel data of the input target on the basis of information of the peripheral pixel data. The data correcting circuit 15 adds a predetermined correction to the image data of the input target, and transmits it to the data line driving circuit 7.

Figure 3:
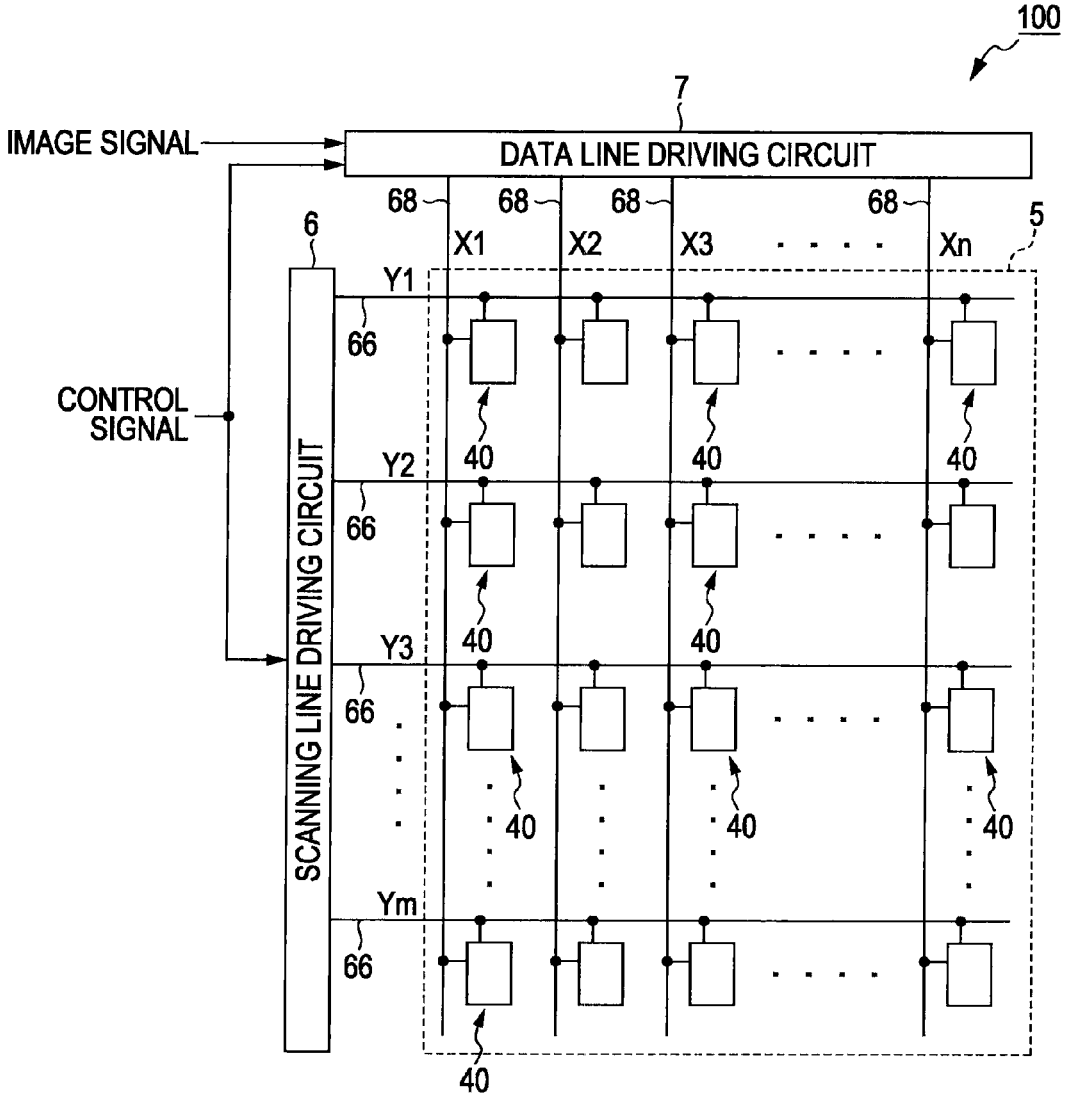
FIG. 3 is a circuit diagram illustrating a schematic configuration of the electrophoretic display device of the first embodiment.

FIG. 3 is a circuit diagram illustrating a schematic configuration of the electrophoretic display device 100 according to the embodiment.

The electrophoretic display device 100 has a display unit 5 in which a plurality of pixels 40 are arranged. The scanning line driving circuit 6 and the data line driving circuit 7 are provided around the display unit 5. The scanning line driving circuit 6 and the data line driving circuit 7 are connected to the controller 3.

The display unit 5 is provided with a plurality of scanning lines 66 extending from the scanning line driving circuit 6 and a plurality of data lines 68 extending from the data line driving circuit 7, and pixels 40 are provided corresponding to intersection positions thereof.

The scanning line driving circuit 6 is connected to the pixels 40 through m scanning lines 66 (Y1, Y2, Y3, . . . , Ym) arranged in a line direction, sequentially selects the scanning lines 66 from the first line to the m-th line under the control of the controller 3, and supplies a selection signal prescribing on-time of selection transistors 41 (see FIG. 4) provided in the pixels 40 to the pixels 40 through the selected scanning lines 66.

The data line driving circuit 7 is connected to the pixels 40 through n data lines 68 (X1, X2, X3, . . . Xn) arranged in the line direction, and supplies to the pixels 40 image signals prescribing image data corresponding to the pixels 40 under the control of the controller 3.

In the embodiment, when prescribing image data (pixel data) "0" (white) in a case of a white background, in other words, white, a low level (L) image signal is supplied to the pixels 40, and when prescribing image data (pixel data) "1" (black), a high level (H) image signal is supplied to the pixels 40. When prescribing intermediate-gradation pixel data, an intermediate level image signal from L to H is supplied to the pixels 40.

Figure 4:
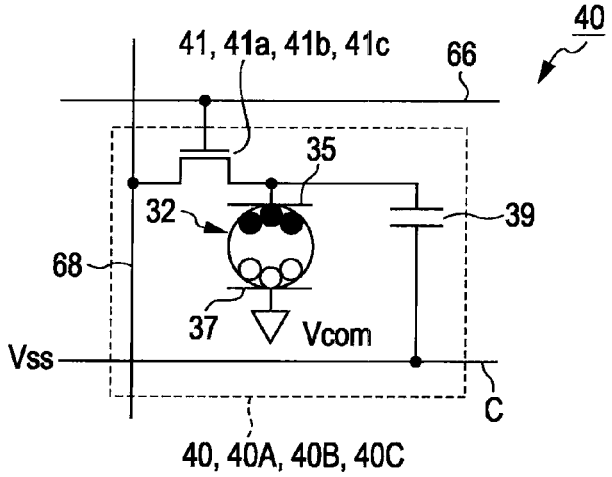
FIG. 4 is a diagram illustrating a pixel circuit.

FIG. 4 is a circuit diagram of the pixels 40.

Each pixel 40 of the display unit 5 is provided with a selection transistor 41, a pixel electrode 35, an electrophoretic element 32 (electro-optic material layer), a common electrode 37, and a storage capacitor 39.

One electrode of the storage capacitor 39 is connected to a drain of the selection transistor 41, and the other electrode is connected to a capacity line C. As for the pixel circuit, when the scanning line 66 is selected, the selection transistor 41 is turned on, an image signal is input from the data line 68 to the pixel electrode 35 through the selection transistor 41, and the storage capacitor 39 is charged. When the scanning line 66 is not selected, the selection transistor 41 is turned off, but charged particles of the electrophoretic element 32 are moved by energy which can be stored in the storage capacitor 39 thereafter.

Figure 5A:
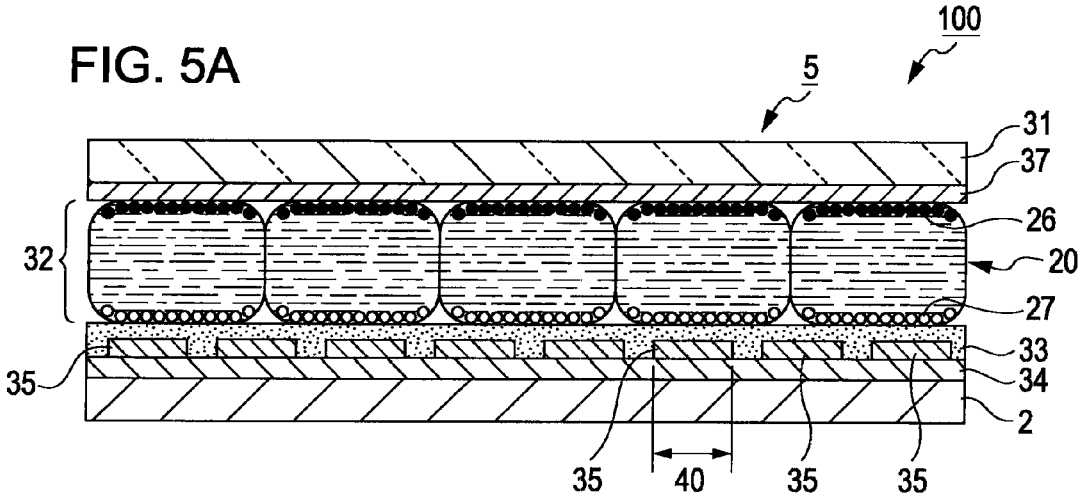
FIG. 5A is a cross-sectional view of the electrophoretic display device.

FIG. 5A is a partial cross-sectional view of the electrophoretic display device 100 at the display unit 5.

The electrophoretic display device 100 has a configuration of pinching the electrophoretic element 32 in which a plurality of microcapsules 20 are arranged between the element substrate 2 and the opposite substrate 31. A plurality of pixel electrodes 35 are arranged and formed on the side of the electrophoretic element 32 of the element substrate 2, which is opposed to the display unit 5, and the electrophoretic element 32 is adhered to the pixel electrode 35 through an adhesive layer 33.

The element substrate 2 is a substrate formed of glass, plastic, or the like, and may not be transparent since it is provided on the opposite side to the image display face. The pixel electrode 35 is an electrode formed by laminating nickel plating and gold plating on a Cu foil or by Al, ITO (indium tin oxide), or the like, in this order. Although not shown, the scanning line 66, the data line 68, the selection transistor 41, and the like shown in FIG. 3 and FIG. 4 are formed between the pixel electrode 35 and the element substrate 2.

The opposite substrate 31 is a substrate formed of glass, plastic, or the like, and is a transparent substrate since it is provided on the image display side. A planar common electrode (opposite electrode) 37 opposed to the plurality of pixel electrode 35 is formed on the electrophoretic element 32 side of the opposite substrate 31, and the electrophoretic element 32 is provided on the common electrode 37. The common electrode 37 is a transparent electrode formed of MgAg, ITO, IZO (indium zinc oxide), or the like.

The electrophoretic element 32 is generally considered as an electrophoretic sheet formed in advance on the opposite substrate 31 side and including the adhesive layer 33. In a production process, the electrophoretic sheet is handled in a state where a protection peeling sheet can be attached to the surface of the adhesive layer 33. The electrophoretic sheet from which the peeling sheet is peeled off is attached to the separately produced element substrate 2 (pixel electrode 35, various circuits, and the like are formed), thereby forming the display unit 5. For this reason, the adhesive layer 33 exists only on the pixel electrode 35 side.

Figure 5B:
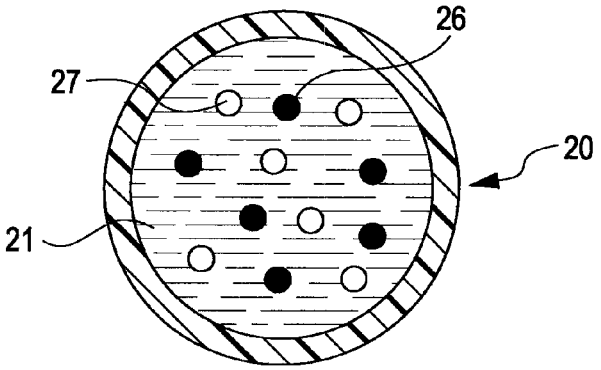
FIG. 5B is a cross-sectional view of a microcapsule.

FIG. 5B is a schematic cross-sectional view of the microcapsule 20.

The microcapsule 20 has a diameter of, for example, about 50 μm, and is a spherical body in which a dispersion medium 21, a plurality of white particles (electrophoretic particles) 27 and a plurality of black particles (electrophoretic particles) 26 are sealed therein. As shown in FIG. 5A, the microcapsules 20 are pinched between the common electrode 37 and the pixel electrode 35, and one or more microcapsules 20 are provided in one pixel 40.

An outer shell portion (wall film) of the microcapsule 20 is formed using acrylic resin such as polymethyl methacrylate and polyethyl methacrylate, and polymer resin having translucency such as urea resin and gum arabic.

The dispersion medium 21 is a liquid in which white particles 27 and black particles 26 are dispersed in the microcapsule 20. Examples of the dispersion medium 21 include water, alcoholic solvents (methanol, ethanol, isopropanol, butanol, octanol, methyl cellosolve, etc.), esters (ethyl acetate, butyl acetate, etc.), ketones (actone, methyl ethyl ketone, methyl isobutyl ketone, etc.), aliphatic hydrocarbons (pentane, hexane, octane, etc.), alicyclic hydrocarbons (cyclohexane, methylcyclohexane, etc.), aromatic hydrocarbons (benzene, toluene, benzenes having a long-chain alkyl group (xylene, hexyl benzene, butyl benzene, octyl benzene, nonyl benzene, decyl benzene, undecyl benzene, dodecyl benzene, tridecyl benzene, tetradecyl benzene, etc.)), halogenated hydrocarbons (methylene chloride, chloroform, carbon tetrachloride, 1,2-dichloroethane, etc.), carboxylates, and the like, and may include other kinds of oils. Such a substance may be used as a single or mixed material, and surfactant or the like may be further mixed in.

The white particles 27 are, for example, particles (polymer or colloid) formed of white pigment such as titanium dioxide, and zinc and antimony oxide, and are for example, negatively electrically charged and used. The black particles 26 are, for example, particles (polymer or colloid) formed of black pigment such as aniline black and carbon black, and are for example, positively charged and used. A charge-controlling agent formed of particles such as electrolytes, a surfactant, metal soap, resin, rubber, oil, varnish, or a compound, a titan coupling agent, an aluminum coupling agent, a dispersing agent such as a silane coupling agent, a lubricant, a stabilizing agent, and the like may be added to such a pigment as necessary.

A pigment such as red, green, and blue may be used instead of the black particles 26 and the white particles 27. With such a configuration, red, green, blue, and the like may be displayed on the display unit 5.

Figure 6A:
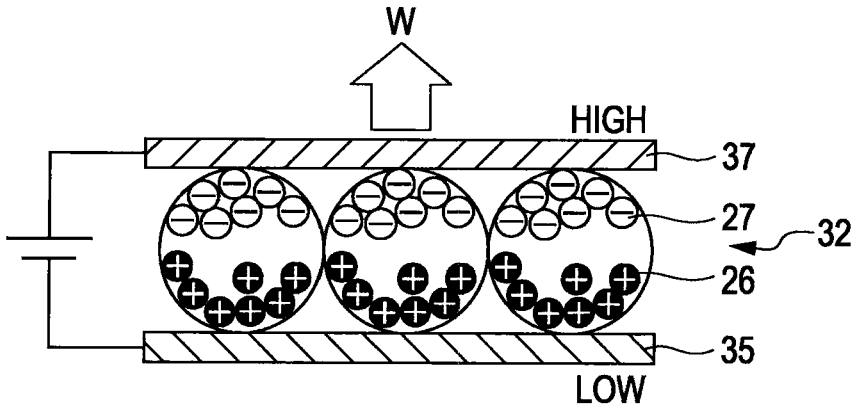
FIG. 6A and FIG. 6B are diagrams illustrating an operation of the electrophoretic element.
Figure 6B:
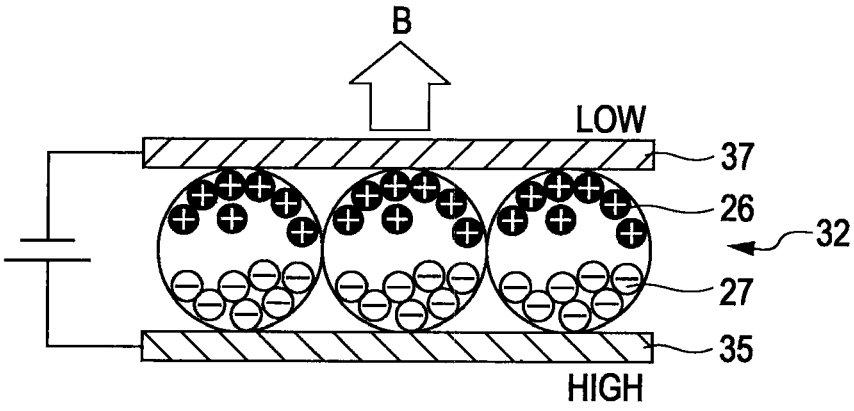

FIG. 6A and FIG. 6B are diagrams illustrating an operation of the electrophoretic device. FIG. 6A shows a case of white display of the pixels 40, and FIG. 6B shows a case of black display of the pixels 40.

In the case of the white display shown in FIG. 6A, the common electrode 37 is maintained with relatively high potential, and the pixel electrode 35 is maintained with relatively low potential. Accordingly, the negatively charged white particles 27 can be drawn to the common electrode 37, and the positively charged black particles 26 can be drawn to the pixel electrode 35. As a result, white (W) is recognized when viewing the pixels from the common electrode 37 that is the display face side.

In the case of the black display shown in FIG. 6B, the common electrode 37 is maintained with relatively low potential, and the pixel electrode 35 is maintained with relatively high potential. Accordingly, the positively charged black particles 26 can be drawn to the common electrode 37, and the negatively charged white particles 27 can be drawn to the pixel electrode 35. As a result, black (B) is recognized when viewing the pixels from the common electrode 37.

Although FIGS. 6A and 6B are diagrams illustrating an operation when the black particles are positively charged and the white particles are negatively charged, the black particles may be negatively charged and the white particles may be positively charged. In this case, when potential is supplied as described above, it is possible to obtain a display in which the white display and the black display are reversed.

Figure 7A:
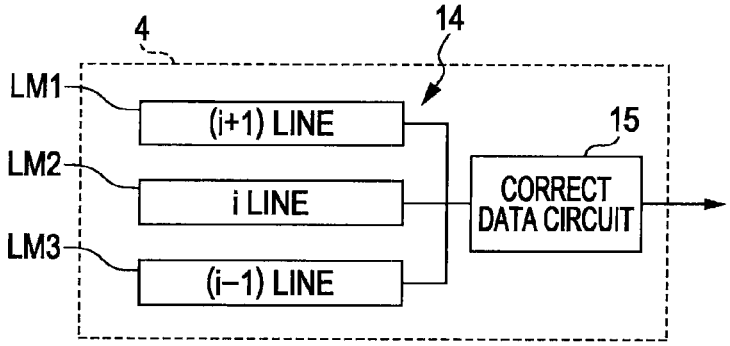
FIG. 7A is a diagram illustrating a configuration of the pixel data input circuit.
Figure 7B:
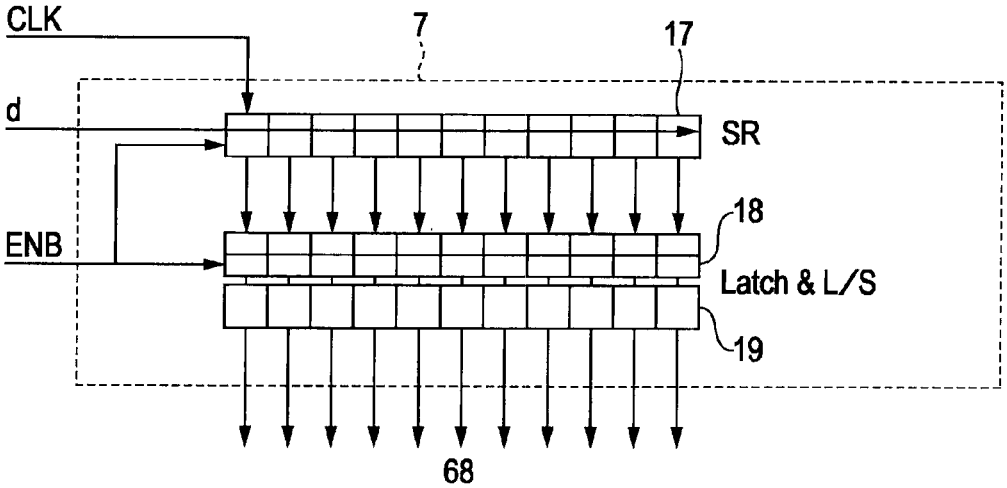
FIG. 7B is a diagram illustrating a configuration of a data driving circuit.

FIG. 7A is a diagram illustrating a configuration and an operation of the image data input circuit 4, and FIG. 7B is a diagram illustrating a configuration and an operation of the data line driving circuit 7.

As shown in FIG. 7A, the image data input circuit 4 is provided with a storage unit 14 including a plurality of line memories LM1, LM2, and LM3, and a data correcting circuit 15. The image data input circuit 4 is a circuit correcting pixel data corresponding to the pixels 40 of the input target on the basis of information of peripheral pixel data of pixel data constituting image data, and supplying the corrected pixel data to the data line driving circuit 7.

Each of the line memory LM1, LM2, and LM3 of the storage unit 14 stores line data formed of pixel data of one line in the image data (i.e., display image) of the input target, and has a storage capacity that can store pixel data of at least one line. In the embodiment, the storage unit 14 has a configuration of storing line data of a total of 3 lines of the line data of the input target and line data before and after the line data. In the embodiment, the image data (plurality of continuous line data) output from the controller 3 is not directly supplied to the data line driving circuit 7, and is written and stored in order of the first line memory LM1, the second line memory LM2, and the third line memory LM3.

FIG. 7A shows the image data input circuit 4 when i ($1 \leq i \leq m$) line pixel data are transmitted to the data line driving circuit 7. The third line memory LM3 receives line data of (i−1) line which is 1 line before the line data of the input target, and the second line memory LM2 receives line data of i line that is the line data of the input target. The first line memory LM1 receives line data of (i+1) line which is 1 line after the line data of the input target.

When the line data of (i+1) line after i line is transmitted to the data line driving circuit 7, line data of i line, (i+1) line, and (i+2) line are stored in the line memories LM1 to LM3. That is, the storage unit 14 sequentially transmits the line data in the line memories LM1 to LM3 to change the line data transmitted to the data line driving circuit 7, and new line data supplied from the controller 3 to the empty first line memory LM1 is extracted by the sequential transmitting operation.

The data correcting circuit 15 reads the pixel data included in the i line of the input target with the peripheral pixel data from the storage unit 14, performs correction on the basis of the information of the peripheral pixel data, and transmits it to the data line driving circuit 7. Specifically, among the line data of the i line stored in the second line memory LM2, the correction is performed on the basis of a result of a Boolean operation using the pixel data (pixel data of input target; e.g., pixel data of j address (line number)) transmitted to the data line driving circuit 7 and the peripheral pixel data (e.g., pixel data of j−1 address and j+1 address included in line data of i line, and pixel data of j−1 address, j address, and j+1 address included in line data of (i−1) line and (i+1) line).

As shown in FIG. 7B, the data line driving circuit 7 is provided with, for example, a shift register 17, a latch circuit 18, and a level shifter 19. In 1 scanning period (1 selection period of scanning line 66), the data line driving circuit 7 latches the corrected pixel data d transmitted from the data correcting circuit 15 as many as n corresponding to the number of data lines 68, then converts the latched n pixel data d into image signals in the next scanning period by the level shifter 19, and outputs them to the corresponding data lines 68 all together.

Specifically, in the data line driving circuit 7 shown in FIG. 7B, the shifter register 17 transmits a data enable signal ENB supplied for the first time of the scanning period according to a data clock CLK, and supplies it as a latch signal to the latch circuit 18. The latch circuit 18 has a configuration provided with a 2-stage latch circuit corresponding to the pixel data d, and the pixel data d is latched to a first stage latch circuit operated according to the latch signal. The second stage latch circuit latches the pixel data d latched by the first stage latch circuit according to the data enable signal ENB all together. The pixel data d latched by the second stage latch circuit are converted into image signals through the level shifter 19, and the signals are supplied to the data lines 68.

Driving Method

Next, a driving method related to an image update in the electrophoretic display device 100 will be described. In the embodiment, as an example, a driving method in a case of displaying an image of "Ab" on the display unit 5, then erasing the image such that the whole face becomes a white display, and updating it into a predetermined image will be described.

Figure 8:
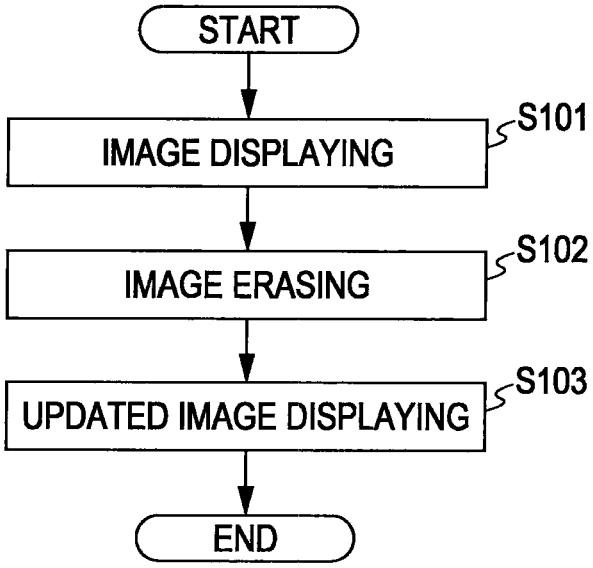
FIG. 8 is a flowchart illustrating image updating.

FIG. 8 is a flowchart of the image update. The steps of the image update of the embodiment include an image display step S101, an image erasing step S102, and an updated image displaying step S103.

Image Displaying Step

First, the image displaying step S101 will be described. The image displaying step S101 is a step of displaying an image on the display unit 5. Specifically, in the image displaying step S101 of the embodiment, an image P1 shown in FIG. 9A is displayed on the display unit 5.

In FIG. 9A, pixels 40A are pixels 40 forming the image P1, and the pixels 40B are pixels 40 disposed adjacent to the pixels 40A to form a background. Pixels 40C are pixels 40 disposed adjacent to the pixels 40B to form a background, and are pixels 40 positioned on the opposite side to the pixels 40A about the pixels 40B. In FIG. 9A, although the signs 40A, 40B, and 40C indicate one pixel 40, the pixels 40A, 40B, and 40C correspond to a plurality of pixels 40 satisfying the conditions. Accordingly, the display unit 5 includes the plurality of pixels 40A, 40B, and 40C.

In the embodiment, since the image P1 is a character image formed of a line drawing of 1 pixel width, the pixels 40A are pixels forming the image P1 and are pixels forming an outline of the image P1.

In the image displaying step S101, at least the data correcting circuit 15 does not function. In an example of a specific operation, image data output from the controller 3 are input to the image data input circuit 4 for each line data, and are sequentially transmitted to the line memories LM1 to LM3. Within a period in which a line is selected, line data (line data stored in the second line memory LM2) corresponding to the line is output to the data line driving circuit 7 through the data correcting circuit 15. At this time, an operation is not carried out in the data correcting circuit 15, and the line data output from the second line memory LM2 is supplied to the data line driving circuit 7. The data line driving circuit 7 converts the input line data into image signals, and supplies the image signals to the pixels 40 through the data lines 68. In the image displaying step S101, the potential of the common electrode 37 is a low level (L; e.g., 0V).

In the pixels 40A forming the black pixels of the image P1, image signals of a high level (H; e.g., 15V) are input from the data lines 68 to the pixel electrodes 35 through the selection transistors 41*a*. In the pixels 40B and 40C forming the background, image signals of a low level (L; e.g., 0V) are input from the data lines 68 to the pixel electrodes 35 through the selection transistors 41*b* and 41*c*.

In the pixels 40A to which the high level (H) image signals are input, the pixel electrodes 35 reach a relatively high potential, the common electrode 37 reaches a relatively low potential, and thus the electrophoretic element 32 operates with a black display. Accordingly, the image P1 of "Ab" shown in FIG. 9A is displayed. In the pixels 40B and 40C to which the low level (L) image signals are input, the pixel electrodes 35 and the common electrode 37 become the same potential, and thus display is not changed. Herein, the background part other than the image P1 is displayed in white.

After the image P1 is displayed, at least the common electrode 37 is maintained in a high impedance state. Accordingly, the display state of the pixel 40 is prevented from being changed thereafter, and the display image P1 is maintained.

Image Erasing Step

Next, the image erasing step S102 will be described, but prior to this, a problem in the known driving method (reverse erasing) will be described with reference to FIG. 18A, FIG. 18B, FIG. 19A, and FIG. 19B.

Figure 18A:
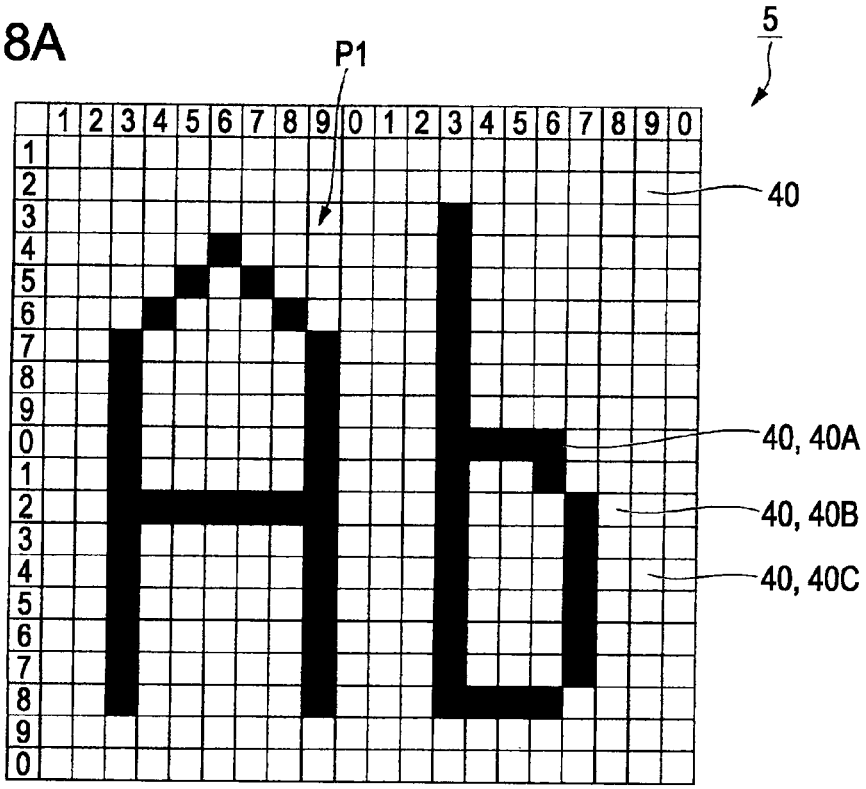
FIG. 18A and FIG. 18B are diagrams illustrating a state of a display unit at the image updating time in the known driving method.
Figure 18B:
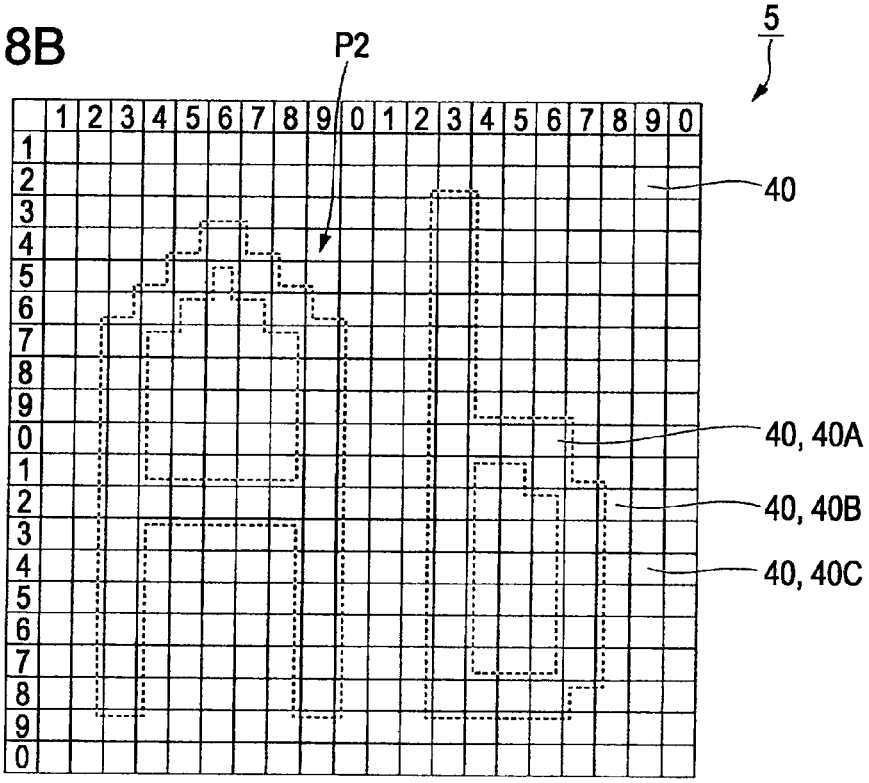

FIG. 18A and FIG. 18B are diagrams illustrating a change of the display unit 5 when the image P1 is selectively erased. FIG. 18A shows a state before an erasing operation, and FIG. 18B shows a state, in which only the pixels 40A forming the image P1 are driven, of selectively erasing the image P1.

In FIG. 18A, when the image erasing is performed by driving only the pixels 40A forming the image P1, a residual image P2 according to an outline of the image P1 is generated on the display unit 5 as shown in FIG. 18B. The residual image P2 is generated at a boundary part between the pixels 40A forming the image P1 and the pixels 40B disposed adjacent to the pixels 40A to form the background.

Figure 19A:
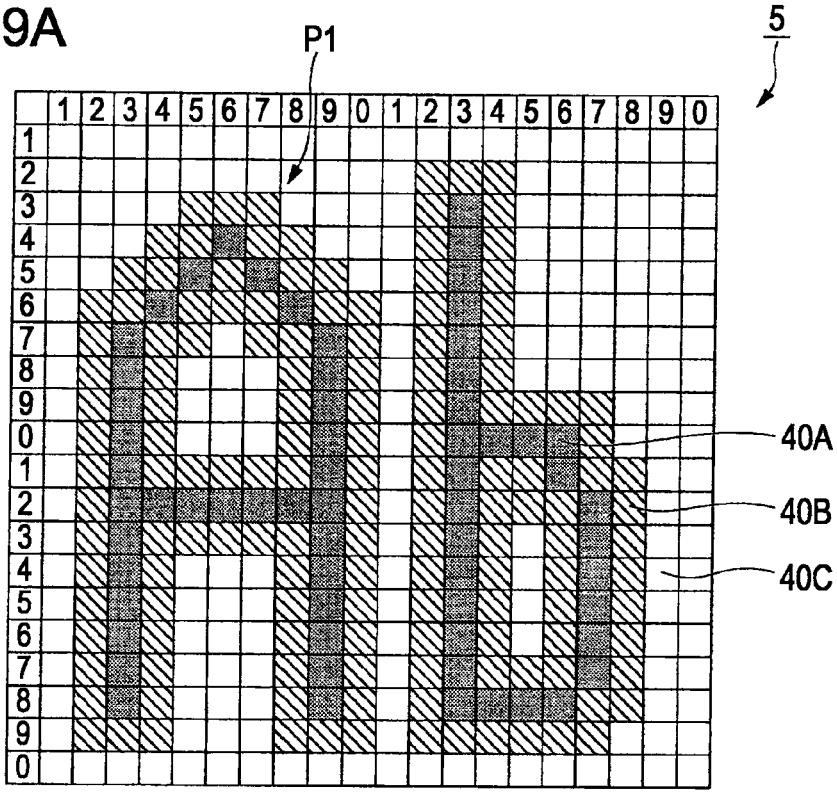
FIG. 19A and FIG. 19B are diagrams illustrating an erasing frame corresponding to a display image in the known driving method.

The generation of the residual image P2 can be avoided by driving the pixels 40A forming the image P1 and the peripheral pixels 40B to perform the image erasing. FIG. 19A is a diagram illustrating an erasing target area set so as not to generate the residual image P2, and FIG. 19B is a diagram illustrating image data for erasing the outline corresponding to FIG. 19A.

As shown in FIG. 19A, to erase the image P1 without generating the residual image P2, the pixels 40A forming the image P1 and the pixels 40B disposed adjacent to the pixels 40A to form the background are driven. That is, the erasing operation is performed on a part of the peripheral background as well as the image P1, and the electrophoretic element 32 positioned at the boundary part between the pixels 40A and the pixels 40B is driven to prevent the residual image P2 (see FIG. 18B) from occurring.

Figure 19B:
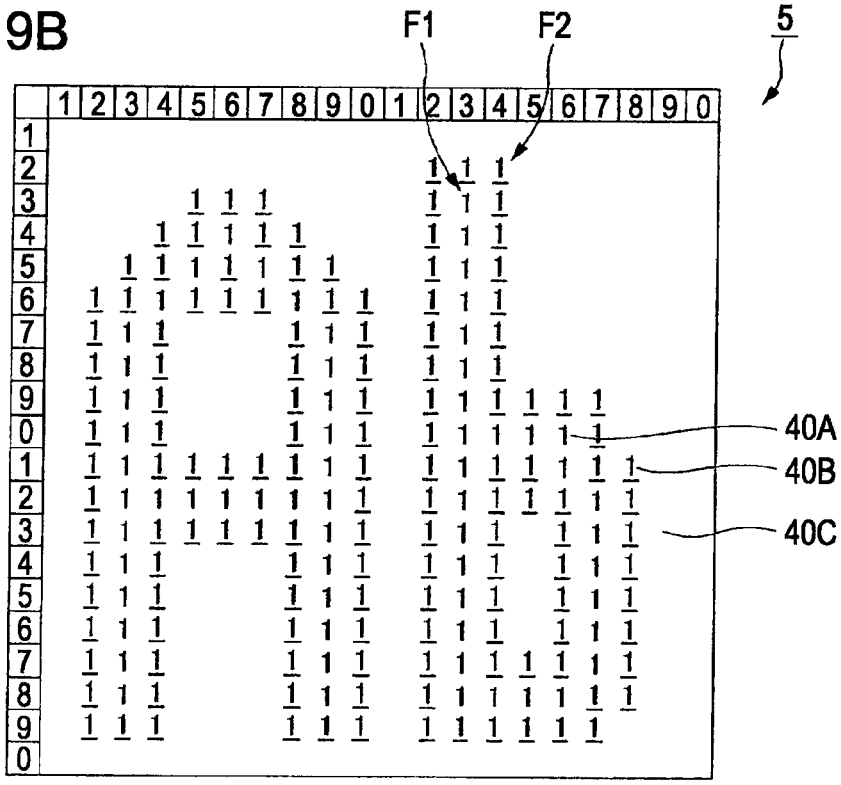

However, to perform such an erasing method, as shown in FIG. 19B, it is necessary to create image data in which image data F2 of the outline part is added to image data F1 of the image P1. Accordingly, it is necessary to provide the host computer PC or the controller 3 with a second frame memory or the like storing image data for erasing, in addition to a first frame memory storing image data corresponding to the image P1. Processing time or power consumption of the CPU increases through the operation process of generating the image data.

On the contrary, in the driving method of the embodiment, to be described below, it is possible to perform erasing of the image P1 without generating a residual image by a driving method of sequentially correcting image data using the image data input circuit 4.

The image data used in the image erasing step S102 of the embodiment is image data corresponding to the image P1 shown in FIG. 9A. On being transferred to the image erasing step S102, line data constituting the image data of the image P1 are sequentially output from the controller 3 to the image data input circuit 4, and are stored in the line memories LM1 to LM3. When the data correcting circuit 15 reads pixel data from the second line memory LM2 in which the line data of the input target is stored, the data correcting circuit 15 acquires pixel data also from the first line memory LM1 and the third line memory LM3. For example, when the first line memory LM1 receives line data of (i+1) line, the second line memory LM2 receives line data of i line, and the third line memory LM3 receives line data of (i−1) line, the pixel data of the input target is pixel data $d_{i,j}$ of j address of line data of i line. In this case, the data correcting circuit 15 acquires the pixel data $d_{i,j}$, and also acquires pixel data adjacent to the pixel data $d_{i,j}$ from the line memories LM1 to LM3. Thereafter, the data correcting circuit 15 carries out a Boolean algebraic operation using information (herein, gradation values) of the acquired peripheral pixel data as shown in the following formula (1).

Formula 1

$$d=d_{i+1,j-1}+d_{i+1,j}+d_{i+1,j+1}+d_{i,j+1}d_{i,j}+d_{i,j+1}+d_{i-1,j-1}+d_{i-1,j}+d_{i-1,j+1} \quad (1)$$

Herein, $d_{m,n}$ is pixel data of n address of line data corresponding to m line. In a case of pixel data corresponding to the black display, "1" is taken, and in a case of pixel data corresponding to the white display, "0" is taken.

The data correcting circuit 15 is configured by a 9-input logic circuit shown in Table 1. When the pixel data $d_{i,j}$ of the input target is "1" (black) and when any one of the peripheral pixel data adjacent to the pixel data of the input target is "1" (black), the pixel data d of the input target becomes "1" as a result of the operation.

TABLE 1

| | j − 1 | 1 | j + 1 |
|---|---|---|---|
| i + 1 | $d_{i+1j-1}$ | $d_{i+1j}$ | $d_{i+1j+1}$ |
| i | $d_{ij-1}$ | $d_{ij}$ | $d_{ij+1}$ |
| i − 1 | $d_{i-1j-1}$ | $d_{i-1j}$ | $d_{i-1j+1}$ |

The pixel data d created from the data correcting circuit 15 by the operation is transmitted as pixel data of j address to the data line driving circuit 7. During the selection period of (i−1) line, the data line driving circuit 7 sequentially takes the pixel data d corresponding to the line data of i line transmitted from the data correcting circuit 15 by the operation of the shift register 17, in the latch circuit 18 (first stage). After the latch circuit 18 (first stage) receives the pixel data d of 1 line, at the time of selecting the scanning line 66 of i line by the scanning line driving circuit 6, the pixel data d are latched all together by the latch circuit of the first stage to second stage in the latch circuit 18. Accordingly, at the period when the selection transistors 41 of the pixels 40 included in the scanning line 66 of i line are turned on, the image signals are supplied from the latch circuit 18 in the data line driving circuit 7 to the data lines 68 through the level shifter 19, and potential corresponding to the input pixel data d is input to the pixels 40.

Specifically, as for the input potential, when the value of the pixel data d is "0", potential by which a voltage applied to the electrophoretic element 32 becomes 0 V is input to the pixel electrodes 35, and when the value of the pixel data d is "1", potential by which the pixels 40 are operated with white display is input to the pixel electrodes 35. For example, in the image erasing step S102, when assuming that the potential of the common electrode 37 is turned to 15 V, 15 V is input to the pixel electrodes 35 of the pixels 40 in which the pixel data are "0", and 0 V is input to the pixel electrode 35 of the pixels 40 in which the pixel data are "1". Accordingly, all the pixels 40 of the display unit 5 become the white display and become an erasing state. As described above, the erasing operation of the image P1 and the outline thereof is performed.

Updated Image Displaying Step

Next, transferring to the updated image displaying step S103, the updated image is displayed on the display unit 5 by the controller 3. The specific operation in the updated image displaying step S103 is the same as the former image displaying step S101. That is, the line memories LM1 to LM3 sequentially receive the image data of the updated image output from the controller 3 for each line data. The line data stored in the second line memory LM2 is transmitted to the data line driving circuit 7 without being corrected by the data correcting circuit 15. The data line driving circuit 7 generates image signals from the input image data, and supplies the image signals to the pixels 40 through the corresponding data lines 68. In such a manner, a predetermined updated image is displayed on the display unit 5.

As described above in detail, according to the embodiment, the line memories LM1, LM2, and LM3 of 3 lines and the data correcting circuit 15 that is the simple logic circuit (9-input OR circuit) are used, the pixel data d for erasing is generated from the image data of the displayed image P1 in the course of the image erasing step S102, and the erasing operation can be performed using this.

According to the embodiment, a frame memory for storing the image data for erasing an outline is not necessary, and the image data for erasing the outline need not be generated by, for example, a CPU.

Accordingly, the addition of a large scale circuit is not necessary, there is no CPU load (processing time, power), the outline can be rapidly erased with low power consumption, and thus it is possible to achieve high quality without a residual image.

In the electrophoretic display device 100 of the invention, the configuration of the pixel circuit of the pixels 40 in the display unit 5 is not limited to the above description.

Figure 10:
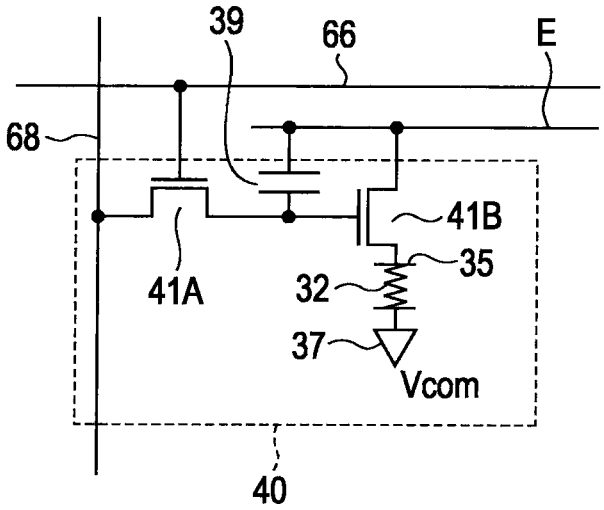
FIG. 10 is a diagram illustrating a modified example of a pixel circuit.

For example, as shown in FIG. 10, the following configuration may be applied in which a selection transistor 41A, a driving transistor 41B, a pixel electrode 35, an electrophoretic element 32, a common electrode 37, and a storage capacitor 39 are provided, and a power supply line E formed by a line unit corresponding to a scanning line 66 is connected to the storage capacitor 39 and the driving transistor 41B.

In FIG. 10, the selection transistor 41A is turned on by a control signal from the scanning line 66, and potential of a data signal from the data line 68 is stored in the storage capacitor 39. The driving transistor 41B supplies driving current from the power supply line E to the electrophoretic element 32 according to the potential of the data signal stored in the storage capacitor 39. Even when the scanning line 66 is not selected, predetermined current is continuously supplied to the electrophoretic element 32 by the storage capacitor 39.

Accordingly, when the selection transistor 41A is reselected at a predetermined time such that the voltage of the storage capacitor 39 is 0, electric power is not supplied to the electrophoretic element 32. Accordingly, the driving of the electrophoretic element 32 is stopped in a desired display state, and gradation display is possible. In the pixel circuit shown in FIG. 10, the image signals supplied from the data driving circuit 7 to the pixels 40 may be considered as current signals. That is, the following configuration may be applied in which the data line driving circuit 7 receives an input of pixel data d that is a voltage signal, and current corresponding to the voltage of the pixel data d is supplied to the data line 68. In this case, the current signals are input to the storage capacitor 39 through the selection transistor 41A, and thus the storage capacitor 39 is charged up to a predetermined voltage.

Next, a modified example of the first embodiment will be described hereinafter.

Modified Example 1

Figure 11A:
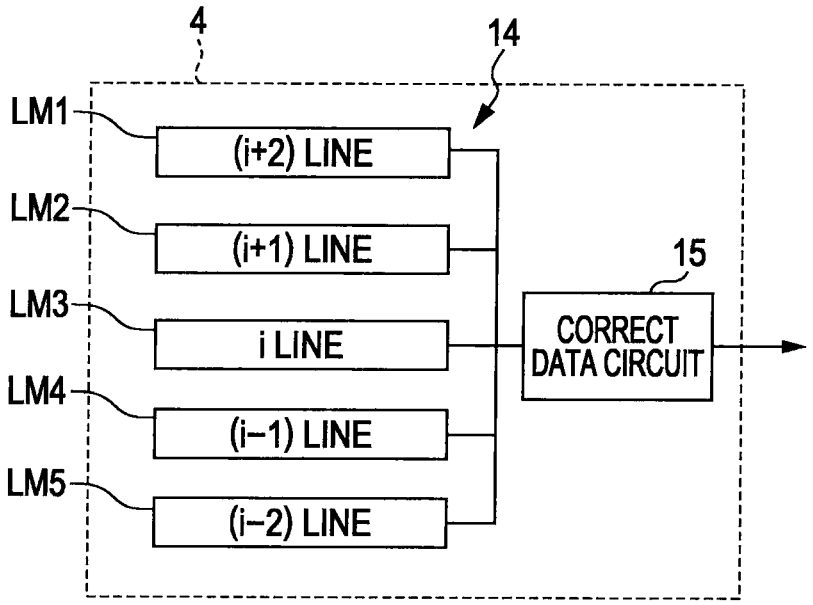
FIG. 11A and FIG. 11B are diagrams illustrating a configuration of the data input circuit in modified examples 1 and 2 of the first embodiment.
Figure 11B:
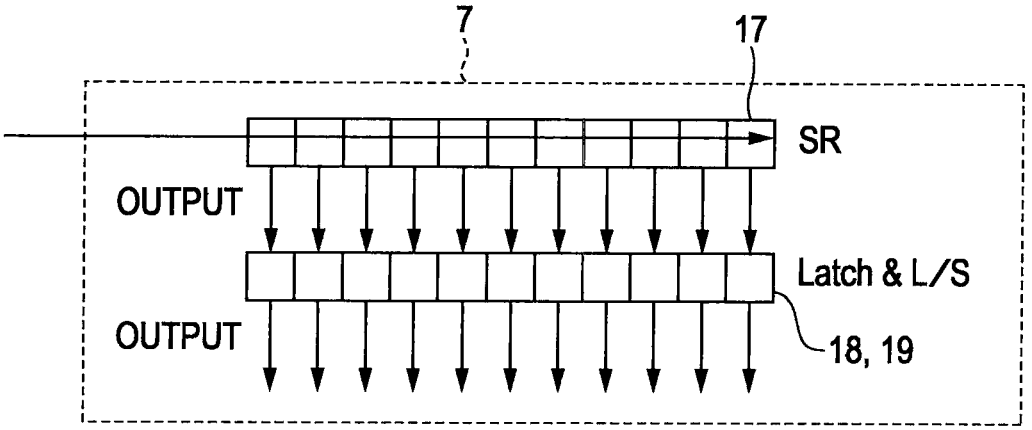

In the above-described first embodiment, the width of the outline at the time of erasing the outline is 1 pixel, but there is a case where it is preferable that the width is 2 pixels or more according to pixel sizes or the like. In Modified Example 1, as shown in FIG. 11A, an image data input circuit 4 which includes 5 line memories LM1, LM2, LM3, LM4, and LM5, and a data correcting circuit 15, and a data line driving circuit 7 shown in FIG. 11B are provided, and a Boolean algebraic operation is calculated using the following formula (2).

Formula 2

$$d = \sum_{k=i-2,\ l=j-2}^{i+2,j+2} d_{k,l} \tag{2}$$

TABLE 2

| | j − 2 | j − 1 | j | j + 1 | j + 2 |
|---|---|---|---|---|---|
| i − 2 | 1 | 1 | 1 | 1 | 1 |
| i − 1 | 1 | 1 | 1 | 1 | 1 |
| i | 1 | 1 | 1 | 1 | 1 |
| i + 1 | 1 | 1 | 1 | 1 | 1 |
| i + 2 | 1 | 1 | 1 | 1 | 1 |

Table 2 shows a type of filter capable of carrying out the operation of the formula (2), and a Boolean algebraic sum of multiplication with values of pixel data of address corresponding to a value of the filter is taken. That is, in the example, the data correcting circuit 15 is configured by a 25-input logic circuit in which pixel data $d_{i,j}$ of the input target and the pixel data of the peripheral 2 pixels are input.

FIG. 12 shows an erasing area based on the pixel data d corrected using the formula (2).

The data correcting circuit 15 receives an input of image data (pixel data of the pixels 40A forming the image P1) of the image P1 by the filter, and sets pixel data of a value "1" for pixels 40B disposed adjacent to the pixels 40A to form the background and pixels 40*b* disposed adjacent to the pixels 40B to form the background on the opposite side of the pixels 40B to the pixels 40A. Herein, outline erasing data (image data of the input target) is configured by pixel data corresponding to the pixels 40A corresponding to the image P1, 2 pixels 40B and 40*b* arranged up, down, left, and right from the pixels 40A, and two pixels 40B and 40*b* obliquely arranged from the pixels 40A. That is, the data correcting circuit 15 generates image data to which correction of expanding the outline of the image P1 outward by 2 pixels is added, and supplies the image data to the data line driving circuit 7.

The data line driving circuit 7 receives an input of the image data, and outputs voltage or current to operate white display of the pixels to the pixels 40A, 40*b*, and 40*b*.

The Boolean algebraic operation may be calculated using the following formula (3).

Formula 3

$$\begin{aligned} d = {} & d_{i+2,j-1} + d_{i+2,j} + d_{i+2,j+1} + d_{i+1,j-2} + \\ & d_{i+1,j-1} + d_{i+1,j} + d_{i+1,j+1} + d_{i+1,j+2} + d_{i,j-2} + \\ & d_{i,j-1} + d_{i,j} + d_{i,j+1} + d_{i,j+2} + d_{i-1,j-2} + d_{i-1,j-1} + \\ & d_{i-1,j} + d_{i-1,j+1} + d_{i-1,j+2} + d_{i-2,j-1} + d_{i-2,j} + d_{i-2,j+1} \end{aligned} \tag{3}$$

TABLE 3

| | j − 2 | j − 1 | j | j + 1 | j + 2 |
|---|---|---|---|---|---|
| i − 2 | 0 | 1 | 1 | 1 | 0 |
| i − 1 | 1 | 1 | 1 | 1 | 1 |
| i | 1 | 1 | 1 | 1 | 1 |
| i + 1 | 1 | 1 | 1 | 1 | 1 |
| i + 2 | 0 | 1 | 1 | 1 | 0 |

Herein, Table 3 shows a type of filter capable of carrying out the operation based on the formula (3). The data correcting circuit 15 provided with the filter shown in FIG. 3 is a 25-input logic circuit as described above, but is different from the filter shown in Table 2 in that 4 pixel data of $d_{i-2,j-2}$, $d_{i-2,j+2}$, $d_{i+2,j-2}$, and $d_{i+2,j+2}$ positioned at an angled portion farthest from the pixel data $d_{i,j}$ of the input target are removed from the target of a Boolean operation.

FIG. 13 shows an erasing area based on the image data for erasing obtained by the formula (3). The data correcting circuit 15 sets pixel data of a value "1" for the pixels 40B (pixels 40 adjacent to the outside of the pixels 40A) and the pixels 40*b* (pixels 40 adjacent to the outside of the pixels 40B), which are based on the image P1 and disposed outside the image P1.

Herein, the outline erasing data are configured by the pixels 40A corresponding to the image P1, the 2 pixels 40B and 40*b* disposed up, down, left, and right from the pixels 40A, and 1 pixel 40B obliquely disposed from the pixels 40A. The data line driving circuit 7 receiving the input of the image data supplies voltage or current for the white display operation of the pixels to the pixels 40A, 40B, and 40*b*.

The type of the filter of the data correcting circuit 15 may be as shown in Table 4 and Table 5.

TABLE 4

| | j − 2 | j − 1 | j | j + 1 | j + 2 |
|---|---|---|---|---|---|
| i − 2 | 1 | 0 | 1 | 0 | 1 |
| i − 1 | 0 | 1 | 1 | 1 | 0 |
| i | 1 | 1 | 1 | 1 | 1 |
| i + 1 | 0 | 1 | 1 | 1 | 0 |
| i + 2 | 1 | 0 | 1 | 0 | 1 |

In the filter shown in Table 4, the coefficient value of the farthest angled portion set to the coefficient value "0" for Table 3 is "1", and the gradation value of the positions up, down, left, and right adjacent to the angled portion is set to "0". According to the filter shown in Table 4, the plurality of pixels 40*b* positioned at the outmost of the image data for erasing shown in FIG. 13 are disposed at the 1-pixel space in a direction along the outline of the pixels 40A corresponding to the image P1.

As described above, the plurality of pixels 40*b* forming the outline of the image data for erasing are disposed at the 1-pixel space, the outer edge of the erasing area is formed in a saw-toothed shape, and thus the boundary with the background does not become a linear shape and is difficult to see.

TABLE 5

| | j − 2 | j − 1 | j | j + 1 | j + 2 |
|---|---|---|---|---|---|
| i − 2 | 0 | 0 | 1 | 0 | 0 |
| i − 1 | 0 | 0 | 1 | 0 | 0 |
| i | 1 | 1 | 1 | 1 | 1 |
| i + 1 | 0 | 0 | 1 | 0 | 0 |
| i + 2 | 0 | 0 | 1 | 0 | 0 |

Next, according to the filter shown in Table 5, as for the pixel data $d_{i,j}$ of the input target, the value "1" is set for the pixel data value up, down, left, and right in the range of 2 pixels, and the outline is expanded. Accordingly, white writing is performed on the 2 pixels (pixels 40B and pixels 40*b* outside them) disposed up, down, left, and right from the pixels 40A corresponding to the outline of the image P1, and the pixels 40 of the background area positioned obliquely from the pixels 40A remain as the background data.

Since a residual image at the time of performing reverse erasing occurs at the boundary portion inserted to the pixels 40 with different gradations, the boundary of the pixels 40 is in the vicinity of the angled portion and it is relatively difficult for a residual image to occur even when the pixels 40 with different gradations in the oblique direction are adjacent to each other. When the filter shown in Table 5 is applied in such a case, the pixels 40 in the area where a residual image does not easily occur can be made so as not to be driven at the erasing time while reliably setting the erasing area in the area where a residual image easily occurs, thereby suppressing power consumption.

Modified Example 2

Next, Modified Example 2 of the first embodiment will be described.

In the first embodiment and Modified Example 1, to easily understand the invention, the coefficient value of the filter is binary of "0" and "1". However, in a case of an electrophoretic display device capable of gradation display, gradation values of pixel data may be corrected by the data correcting circuit 15 to output them to the data line driving circuit 7. Table 6 shows a type of filter capable of coping with the data correcting circuit 15 according to Modified Example 2. The data correcting circuit 15 provided with the filter shown in Table 6 is a 25-input logic circuit, and coefficient values ($w_{i,j}$) of a filter of the corresponding address are applied to gradation values of the pixel data $d_{i,j}$ and gradation values of the peripheral pixels, values obtained by calculating the arithmetic sum thereof are set as pixel data d after correction (see the following formula (4)). The corrected pixel data d is output to the data line driving circuit 7.

In this case, it is natural that the data line driving circuit 7 is configured to output voltage signals or current signals corresponding to the corrected pixel data d to the data lines 68.

TABLE 6

| | j − 2 | j − 1 | j | j + 1 | j + 2 |
|---|---|---|---|---|---|
| i − 2 | $w_{i-2,j-2}$ | $w_{i-2,j-1}$ | $w_{i-2,j}$ | $w_{i-2,j+1}$ | $w_{i-2,j+2}$ |
| i − 1 | $w_{i-1,j-2}$ | $w_{i-1,j-1}$ | $w_{i-1,j}$ | $w_{i-1,j+1}$ | $w_{i-1,j+2}$ |
| i | $w_{i,j-2}$ | $w_{i,j-1}$ | $w_{i,j}$ | $w_{i,j+1}$ | $w_{i,j+2}$ |
| i + 1 | $w_{i+1,j-2}$ | $w_{i+1,j-1}$ | $w_{i+1,j}$ | $w_{i+1,j+1}$ | $w_{i+1,j+2}$ |
| i + 2 | $w_{i+2,j-2}$ | $w_{i+2,j-1}$ | $w_{i+2,j}$ | $w_{i+2,j+1}$ | $w_{i+2,j+2}$ |

Formula 4

$$d = \sum_{k=i-2,\ l=j-2}^{i+2,\ j+2} d_{k,l} w_{k,l} \tag{4}$$

According to the configuration of Modified Example 2, when the pixel data $d_{i,j}$ is corrected, a degree of considering information of the peripheral pixel data can be freely set by the filter shown in Table 6.

For example, coefficient values $w_{i-1,j-1}$, $w_{i-1,i}$, $w_{i-1,j+1}$, $w_{i,j-1}$, $w_{i,j+1}$, $w_{i+1,j-1}$, $w_{i+1,j}$, and $w_{i+1,j+1}$ corresponding to pixel data $d_{i-1,j-1}$, $d_{i-1,i}$, $d_{i-1,j+1}$, $d_{i,j-1}$, $d_{i,j+1}$, $d_{i+1,j-1}$, $d_{i+1,j}$, and $d_{i+1,j+1}$ positioned at a distance from the pixel data $d_{i,j}$ of the input target by 1 pixel are set twice of coefficient values $w_{i-2,j-2}$, $w_{i-2,i-1}$, $w_{i-2,j}$, $w_{i-2,j+1}$, $w_{i-2,j+2}$, $w_{i-1,j-2}$, $w_{i-1,j+2}$, $w_{i,j-2}$, $w_{i,i+2}$, $w_{i+1,j-2}$, $w_{i+1,j+2}$, $w_{i+2,j-2}$, $w_{i+2,j-1}$, $w_{i+2,j}$, $w_{i+2,j+1}$, and $w_{i+2,j+2}$ corresponding to pixel data $d_{i-2,j-2}$, $d_{i-2,i-1}$, $d_{i-2,j+2}$, $d_{i-2,j+1}$, $d_{i-2,j+2}$, $d_{i-1,j-2}$, $d_{i-1,j+2}$, $d_{i,j-2}$, $d_{i,i+2}$, $d_{i+1,j-2}$, $d_{i+1,j+2}$, $d_{1+2,j-2}$, $d_{i+2,j-1}$, $d_{i+2,j}$, $d_{i+2,j+1}$, and $d_{i+2,j+2}$ positioned at a distance by 2 pixels, and contribution of information of pixels adjacent to the pixel data $d_{i,j}$ of the input target may be set high.

When the pixel data d corresponding to the pixel 40B or the pixels 40*b* positioned in the background area originally displayed with white among the pixels 40 shown in FIG. 13 becomes an intermediate gradation value, the erasing driving of rewriting black display into white display is performed on the pixels 40A forming the image P1, and white writing lower than the pixels 40A can be performed on the pixels 40B and 40*b*. Accordingly, it is possible to suppress deviation of current history of the electrophoretic element 32 by further performing the white writing at the white background part, and it is possible to prevent reliability from decreasing.

In Modified Example 2, the correction of the pixel data of the input target is performed using the pixel data of 5 lines and 5 columns, but is not limited thereto, and the number of lines and the number of columns may be increased and decreased as necessary.

Second Embodiment

Next, a second embodiment of the invention will be described. The description of the same constituent elements as the first embodiment is not repeated.

First, a problem in a case of displaying a plurality of images on the display unit 5 will be described.

Figure 14A:
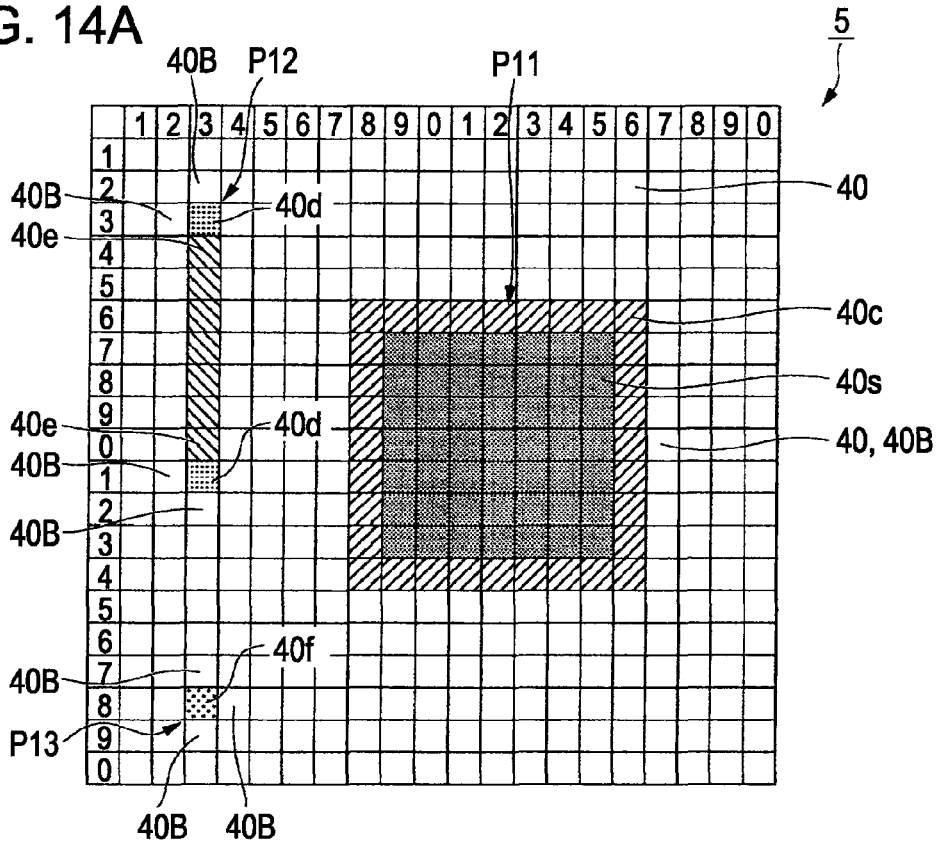
FIG. 14A and FIG. 14B are diagrams illustrating input target pixels in the driving method of a second embodiment.
Figure 14B:
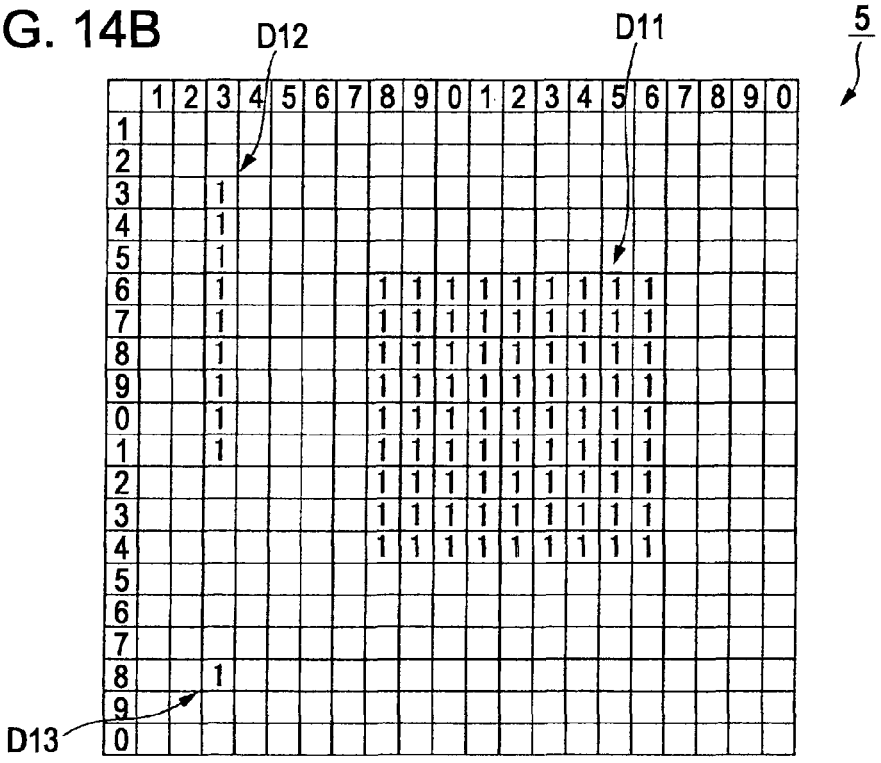

FIG. 14A is a diagram illustrating a state of the display unit 5 when a plurality of images P11 to P13 is displayed. FIG. 14B is a diagram illustrating image data (a state of having been developed in the frame memory) corresponding to the plurality of images P11 to P13. In FIG. 14B, a value of pixel data corresponding to black display is "1", and pixel data of white display ("0") is omitted and blanked.

As shown in FIG. 14B, all image data D11 to D13 of the images P11 to P13 displayed on the display unit 5 are configured by pixel data of the value "1" corresponding to the black display and a group thereof. The image P11 is a square-shaped image of 9×9 pixels, the image P12 is a linear-shaped image of 9×1 pixels, and the image P13 is a dot-shaped image of 1 pixel.

In the electrophoretic display device 100, when the images P11, P12, and P13 are displayed on the display unit 5 using the image data D11 to D13, there is a problem that display color is different according to the positions of the pixels 40 even when the same voltage is applied to the pixel electrodes 35 of the pixels 40 constituting the images P11, P12, and P13 as shown in FIG. 14A.

Specifically, in the image P11, a display color of the pixels 40*c* constituting a frame-shaped area of 1 pixel width positioned at the outline part becomes black (gray) lighter than pixels 40*s* provided inside. In the image P12, all the pixels become a gray display lighter than the pixels 40*c* of the image P11, and pixels 40*d* at both ends of the pixels become a gray display lighter than inner pixels 40*e*. In the image P13 formed of a single pixel 40*f*, the pixel becomes a gray display even lighter than the pixels 40*d* of the image P12.

That is, even when voltage of the same black is applied to the plurality of pixels 40, the display color becomes a gray display close to white as the number of white pixels 40B increases (to the extent that the black pixels are isolated).

To solve this, even when the display is binary display, it is satisfactory that the frame memory is made into multi-bits, data compensating the change of black is stored, and the voltage applied to the pixel electrodes 35 at the time of black display is corrected according to the value. However, the frame memory becomes large. In addition, burden of the CPU to perform correction calculation is increased.

In the electrophoretic display device of the invention, the image data are corrected for the image data input circuit 4, display is performed using the corrected image data, and display unevenness can be prevented from occurring in any of the images P11, P12, and P13. Hereinafter, the electrophoretic display device and the driving method thereof according to the embodiment will be described in detail with reference to the drawings.

Figure 15:
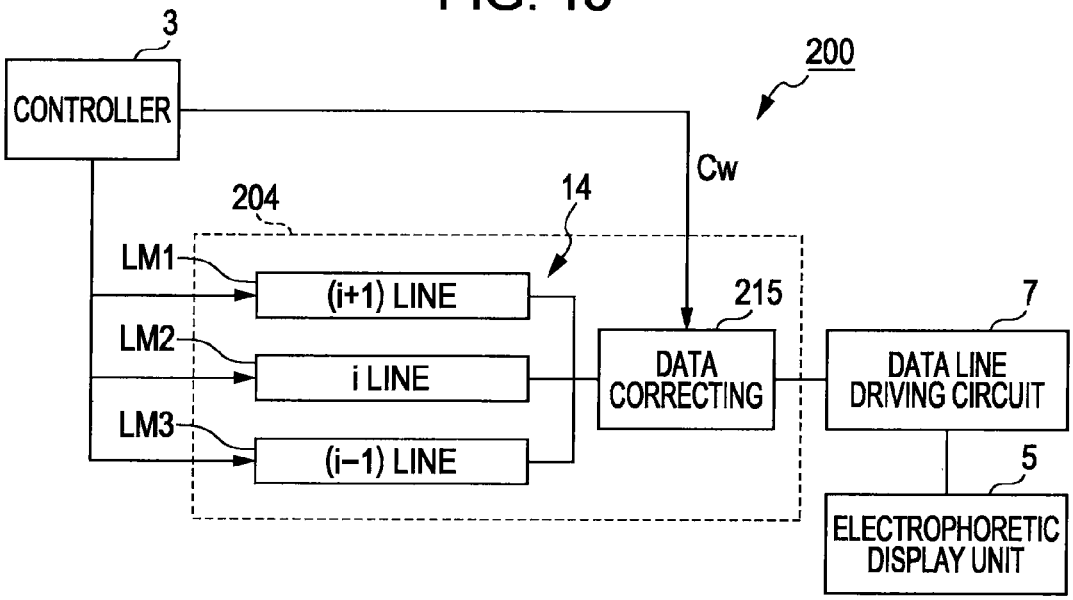
FIG. 15 is a diagram illustrating a gradation value of the input target pixels in the driving method of the second embodiment.

FIG. 15 is a diagram illustrating a schematic configuration of an electrophoretic display device 200 of the embodiment.

As shown in FIG. 15, the electrophoretic display device 200 is provided with an image data input circuit 204. The image data input circuit 204 is provided with a storage unit 14 including 3 line memories LM1 to LM3, and a data correcting circuit 215 connected to the storage unit 14. The data correcting circuit 215 is connected to data line driving circuit 7 and a controller 3, and the number of writing times Cw is input to the controller 3.

Table 7 shows a type of filter used for am operation process of the data correcting circuit 215 of the embodiment. The data correcting circuit 215 provided with the filter is a 9-input logic circuit, and calculates an algebraic sum of pixel data extracted by the filter shown in Table 7. Pixel data $d_{i,j}$ of the input target is corrected on the basis of the value of the sum, and is output as the corrected pixel data d to the data line driving circuit 7.

Although details will be described later, the data correcting circuit 215 performs other operations on the basis of the value of the number of writing times Cw and the value of the algebraic sum input from the controller 3.

TABLE 7

| | j − 1 | j | j + 1 |
|---|---|---|---|
| i − 1 | 1 | 1 | 1 |
| i | 1 | 0 | 1 |
| i + 1 | 1 | 1 | 1 |

Since the display unevenness shown in FIG. 14 occurs when an image is displayed on the display unit 5, the data correcting circuit 215 serves as a circuit for correcting the image data when the image based on the image data is displayed on the display unit 5.

Hereinafter, operations of the electrophoretic display device 200 and the image data input circuit 204 will be described in detail.

Figure 16:
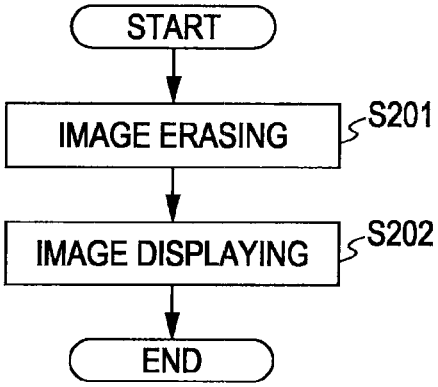
FIG. 16 is a flowchart illustrating a driving method of an electrophoretic display device of the second embodiment.
Figure 17:
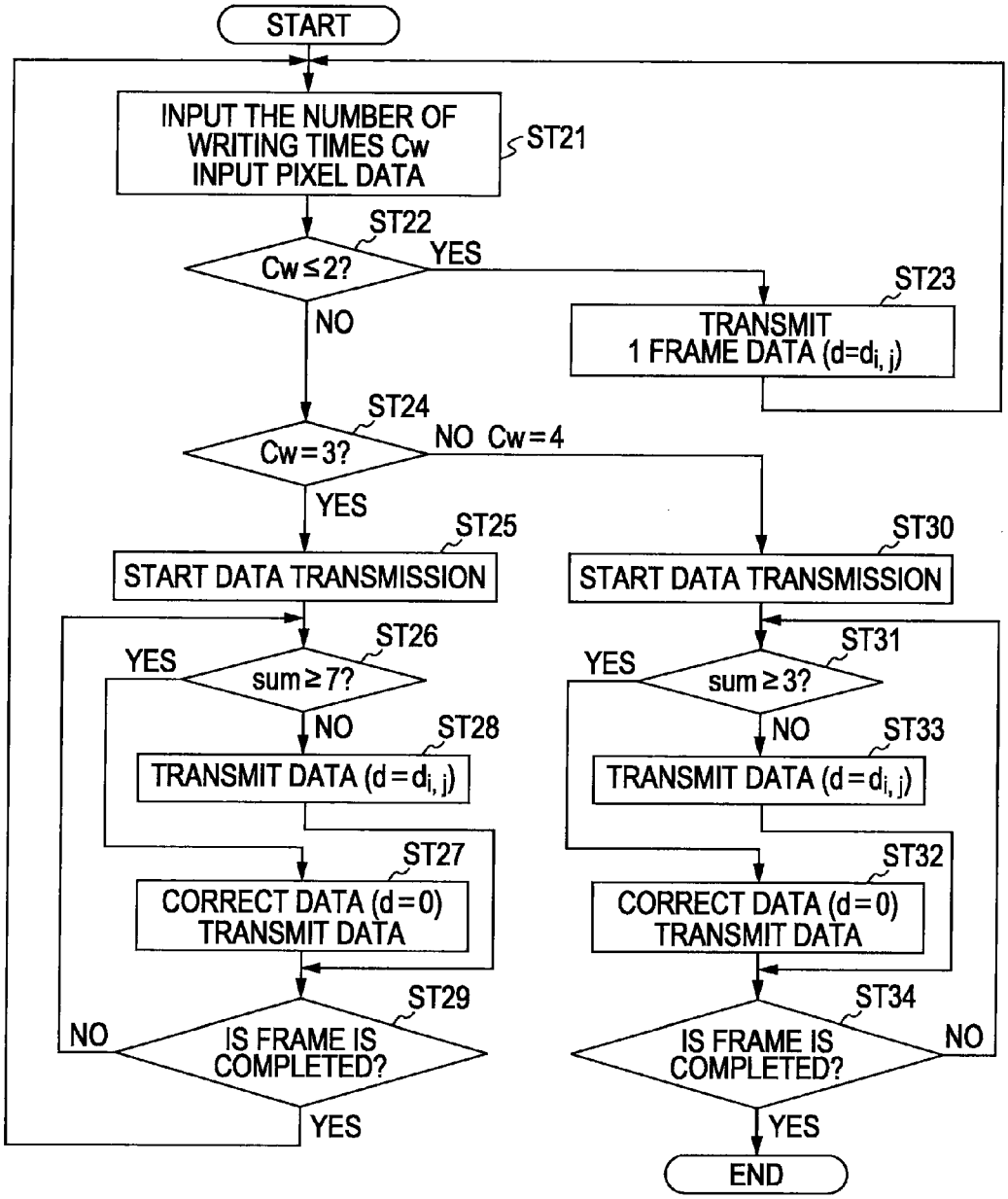
FIG. 17 is a flowchart illustrating an operation of a data correcting circuit.

FIG. 16 is a flowchart illustrating a method of driving the electrophoretic display device 200 of the embodiment, and FIG. 17 is a flowchart illustrating an operation of the data correcting circuit 215.

In the method of driving the electrophoretic display device 200 of the embodiment described below, as shown in FIG. 16, an image erasing step S201 of displaying the whole face of the display unit 5 with white to be in an erasing state, and an image displaying step S202 of displaying a black image on the display unit 5 in which the whole face is displayed with white are performed. In the embodiment, the image displaying step S202 is completed by 4 frames. That is, in the image displaying step, an operation of selecting the scanning line 66 of each line, inputting a predetermined image signal to the pixel 40, and charging the storage capacitor 39 is performed four times.

First, in the image erasing step S201, the display unit 5 is made entirely white and erased. A specific operation in the image erasing step S201 is not limited, the image displaying operation may be performed using image data formed of only pixel data of the value "0" corresponding to white display such that the whole face of the display unit 5 is transferred to the white display. When any image is displayed on the display unit 5, the image erasing step S102 according to the first embodiment and modified examples may be performed.

When the display unit 5 is made entirely white and erased, the process is transferred to the image displaying step S202.

In the image displaying step S202, for example, an image writing operation is performed four times on the display unit 5 using image data (see FIG. 14B) corresponding to the plurality of images P11, P12, and P13 shown in FIG. 14A. In this case, the image data of the images P11 to P13 are supplied to the data line driving circuit 7 through the image data input circuit 204, but the data correcting circuit 215 of the image data input circuit 204 performs other operations on the basis of the pixel data (arithmetic sum) input from the controller 3 through the storage unit 14 and the number of writing times Cw input from the controller 3 as shown in FIG. 15.

In the image displaying step S202, the line memories LM1 to LM3 of the image data input circuit 204 receive the image data provided for display for each line from the controller 3. This operation is the same as the image data input circuit 4 of the first embodiment.

In the data correcting circuit 215, a step ST21 shown in FIG. 17 is started at the time of inputting line data of i line of the input target to the second line memory LM2. In the step ST21, to the data correcting circuit 215, the number of writing times Cw (=1) is input from the controller 3, and the pixel data $d_{i,j}$ of the input target are sequentially input from the line memory LM1 to LM3.

Then, in the step ST22, the value of the number of writing times Cw is evaluated. When the number of writing times Cw is twice or less, the process is transferred to the step ST23, otherwise, the process is transferred to the step ST24. Herein, since the number of writing times Cw is 1, the process is transferred to the step ST23. In the step ST23, pixel data $d(=d_{i,j})$ of 1 frame is output from the data correcting circuit 215 to the data line driving circuit 7 without performing the correction of the pixel data. That is, the data correcting function of the data correcting circuit 215 is not operated for the writing of 1 frame, and the image data supplied from the controller 3 is transmitted to the data line driving circuit 7.

When the step ST23 corresponding to the image writing of the 1 frame is completed, the process returns to the step ST21 and the image writing of 2 frame is started. In the step ST21 at this time, since the number of writing times Cw input from the controller 3 is 2, the transferring to the step ST23 is selected like the 1 frame in the subsequent step ST22. In the step ST23, the data correcting circuit 215 does not correct the image data supplied from the controller 3, and the image data of the 1 frame is transmitted to the data line driving circuit 7.

As described above, in the driving method of the embodiment, up to the 2 frame, the image data supplied from the controller 3 is supplied to the data line driving circuit 7, and the image displaying operation is performed on the display unit 5.

When the image writing of the 2 frame is completed, the process returns to the step ST21 again, and the image writing of 3 frame is started. In Step ST21, since the number of writing times Cw input from the controller 3 is 3, the process is transferred to the step ST24 through the step ST22, and further transferred to the step ST25. When the transmission operation of the data to the data line driving circuit 7 is performed in the step ST25, first, the arithmetic sum of the pixel data extracted using the filter shown in Table 7 is calculated and evaluated in the step ST26.

Specifically, in the step ST26, the total of the data values ("0" or "1") of 8 pixels disposed around the pixel data $d_{i,j}$ of the input target is calculated as a sum. Accordingly, the range of the sum is an integer equal to or larger than 0 and equal to or smaller than 8.

In the evaluation of the value of the sum in the step ST26, when the value of the sum is 7 or more (i.e., 7 or more pixels around the pixel data $d_{i,j}$ of the input target are pixel data corresponding to black display), the process is transferred to the Step ST27. In the step ST27, the pixel data $d_{i,j}$ of the input target is destroyed, and the pixel data d=0 after correction is supplied to the data line driving circuit 7. That is, in the pixels 40 around which a large number of pixels 40 of black display are disposed, the third writing is not performed.

Meanwhile, when the value of the sum is smaller than 7, the process is transferred to the step ST28. In the step ST28, the pixel data $d_{i,j}$ of the input target is not corrected, and is supplied as pixel data d to the data line driving circuit 7. That is, when there are a relatively small number (equal to or larger than 0 and equal to or smaller than 6) of pixels 40 with black display at the periphery, the third black writing is performed.

After the step ST27 or the step ST28 is performed, it is evaluated whether or not data transmission of the 1 frame is completed in the step ST29. When the data transmission is not completed, the steps ST26 to ST28 are performed on the next pixel data $d_{i,j}$. When the data transmission of the 1 frame is completed, the image writing of the 3 frame is completed, and the process returns to the step ST21.

Then, the image writing of 4 frame is started. In Step ST21, since the number of writing times Cw input from the controller 3 is 4, the process is transferred to the step ST24 through the step ST22, and further transferred to the step ST30. When the transmission operation of the data to the data line driving circuit 7 is performed in the step ST30, first, an arithmetic sum of the pixel data is calculated and evaluated in the step ST31.

In the evaluation of the value of the sum in the step ST31, when the value of the sum is 3 or more (i.e., 3 or more pixels around the pixel data $d_{i,j}$ of the input target are pixel data corresponding to black display), the process is transferred to the Step ST32. In the step ST32, the pixel data $d_{i,j}$ of the input target is destroyed, and the pixel data d=0 after correction is supplied to the data line driving circuit 7. That is, in the pixels 40 around which 3 or more pixels 40 of black display are disposed, the fourth writing is not performed.

Meanwhile, when the value of the sum is smaller than 3, the process is transferred to the step ST33. In the step ST33, the pixel data $d_{i,j}$ of the input target is not corrected, and is supplied as pixel data d to the data line driving circuit 7. That is, when there are only 0 to 2 pixels 40 with black display around, the fourth black writing is performed.

After the step ST32 or the step ST33 is performed, it is evaluated whether or not data transmission of the 1 frame is completed in the step ST34. When the data transmission is not completed, the steps ST31 to ST33 are performed on the next pixel data $d_{i,j}$. When the data transmission of the 1 frame is completed, the image displaying step S202 is completed.

As described above, in the embodiment, when there are a lot of pixel data corresponding to the black display around the pixel data $d_{i,j}$ of the input target, the writing is performed twice on the pixels of the input target. When there are some pixel data, the writing is performed three times. When there are a lot of pixel data corresponding to the white display around the pixel data corresponding to the pixels of the input target and there are few pixel data corresponding to the black display, the writing is performed four times.

The relation between the number of black data (the number of pixel data corresponding to the black display) and the number of writing times in the specific example represented by the embodiment is shown in Table 8. In the embodiment, the writing is performed at least twice on all the pixels of the input target, the writing is performed three times on the pixel data in the case where the number of peripheral black data is 3 to 6, and the writing is performed four times in the case where the number of peripheral black data is 7 or 8.

The relation between the number of the peripheral black data and the number of writing times is just an example, and may be appropriately set according to the degree of display unevenness.

TABLE 8

| the number of peripheral black data | the number of writing times |
|---|---|
| 0 | 4 |
| 1 | |
| 2 | |

TABLE 8-continued

| the number of peripheral black data | the number of writing times |
|---|---|
| 3 | 3 |
| 4 | |
| 5 | |
| 6 | |
| 7 | 2 |
| 8 | |

As described in detail above, according to the electrophoretic display device and the driving method thereof of the second embodiment, it is possible to eliminate the display unevenness in which the display of the isolated pixels around which there are little pixels of the black display becomes light and to obtain the uniform and dense display image. In addition, since the writing is not performed unnecessarily on all the pixels of the input target, power consumption is suppressed.

Modified Example

Next, a modified example of the second embodiment will be described.

In the second embodiment, the number of driving times (writing times) of the pixels 40 is controlled according to the number of peripheral black data to solve the display unevenness. However, in a case of an electrophoretic display device capable of gradation display, the gradation values of the pixel data may be corrected by the data correcting circuit 215 to output the gradation values to the data line driving circuit 7.

Table 9 shows a type of filter capable of coping with the data correcting circuit 215 according to Modified Example. The data correcting circuit 215 provided with the filter shown in Table 9 is a 9-input logic circuit, and coefficient values ($w_{i,j}$) of a filter of the corresponding address are applied to gradation values of the pixel data $d_{i,j}$ and gradation values of the peripheral pixels, values obtained by calculating the arithmetic sum thereof are set as pixel data d after correction (see the following formula (5)). The corrected pixel data d is output to the data line driving circuit 7.

In this case, it is natural that the data line driving circuit 7 can output voltage signals or current signals corresponding to the corrected pixel data d to the data lines 68. The invention is not limited to 5 lines and 5 columns shown in Table 6, and the number of lines and the number of columns may be increased and decreased as necessary.

TABLE 9

| | j − 1 | j | j + 1 |
|---|---|---|---|
| i − 1 | $w_{i-1j-1}$ | $w_{i-1j}$ | $w_{i-1j+1}$ |
| i | $w_{ij-1}$ | $w_{ij}$ | $w_{ij+1}$ |
| i + 1 | $w_{i+1j-1}$ | $w_{i+1j}$ | $w_{i+j+1}$ |

Formula 5

$$d = \sum_{k=i-1,\ l=j-1}^{i+1,j+1} d_{k,l} w_{k,l} \tag{5}$$

TABLE 10

| pixel | gradation value (relative value) |
|---|---|
| 40c | 1.2 |
| 40d | 1.4 |
| 40e | 1.3 |
| 40f | 1.5 |
| 40s | 1 |

For example, as shown in FIG. 10, among the pixels 40 forming the images P11, P12, and P13, the gradation values of the pixel data for the pixels 40*c* to 40*f* in which display becomes light can be corrected.

As shown in FIG. 14A and FIG. 14B, the black display of the pixels 40*c* to 40*f* becomes light to the extent that the number of pixels 40 of the black display disposed around is small. As shown in Table 10, the gradation values 1.2 to 1.5 times of the gradation value of the pixel 40*s* from which the densest black display can be obtained, according to the number of pixels 40 of the peripheral black display. Accordingly, in the pixels 40*c* to 40*f*, voltage applied to the electrophoretic element 32 or current input thereto can be increased even by the pixels 40*s*, and thus it is possible to prevent the black display from being light.

As described above, the very preferred embodiment according to the invention has been described, but the invention is not limited to the examples. It is obvious that a person skilled in the art can imagine various modified examples and amended examples within the scope of the technical concept described in Claims, and it is naturally understood that they are included in the technical scope of the invention.

For example, the image data input circuits 4 and 204 (line memories LM1 to 3 and the data correcting circuits 15 and 215) may be built in the controller 3 or the data line driving circuit 7.

In the embodiments, the case where the storage unit 14 is the line memory has been described, but the storage unit 14 may be a frame memory storing image data of 1 frame. In the invention, the original image data are not changed, the pixel data may be directly supplied from the frame memory storing the image data for display to generate or change the pixel data to the data correcting circuits 15 and 215 when the pixel data are transmitted to the data line driving circuit 7 through the data correcting circuits 15 and 215.

When the writing or erasing is performed many times, the image data are not transmitted from the superordinate device and it is completed. Accordingly, power consumption is suppressed, and a processing time of the CPU in the superordinate device can be reduced.

Third Embodiment

Next, a third embodiment of the invention will be described.

Figure 20:
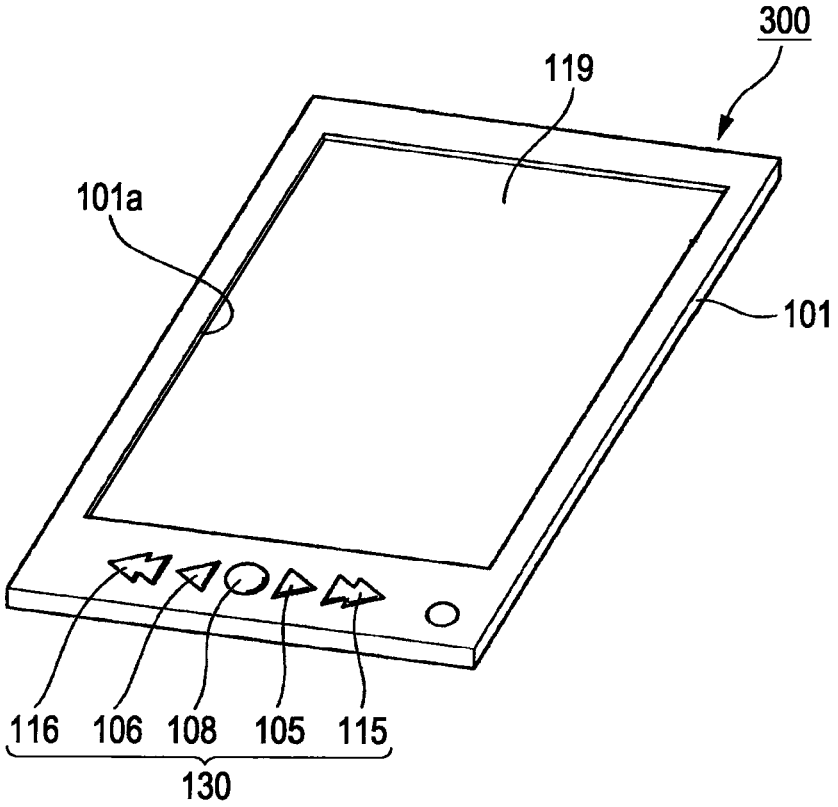
FIG. 20 is an appearance view of an electronic book reader of a third embodiment.
Figure 21:
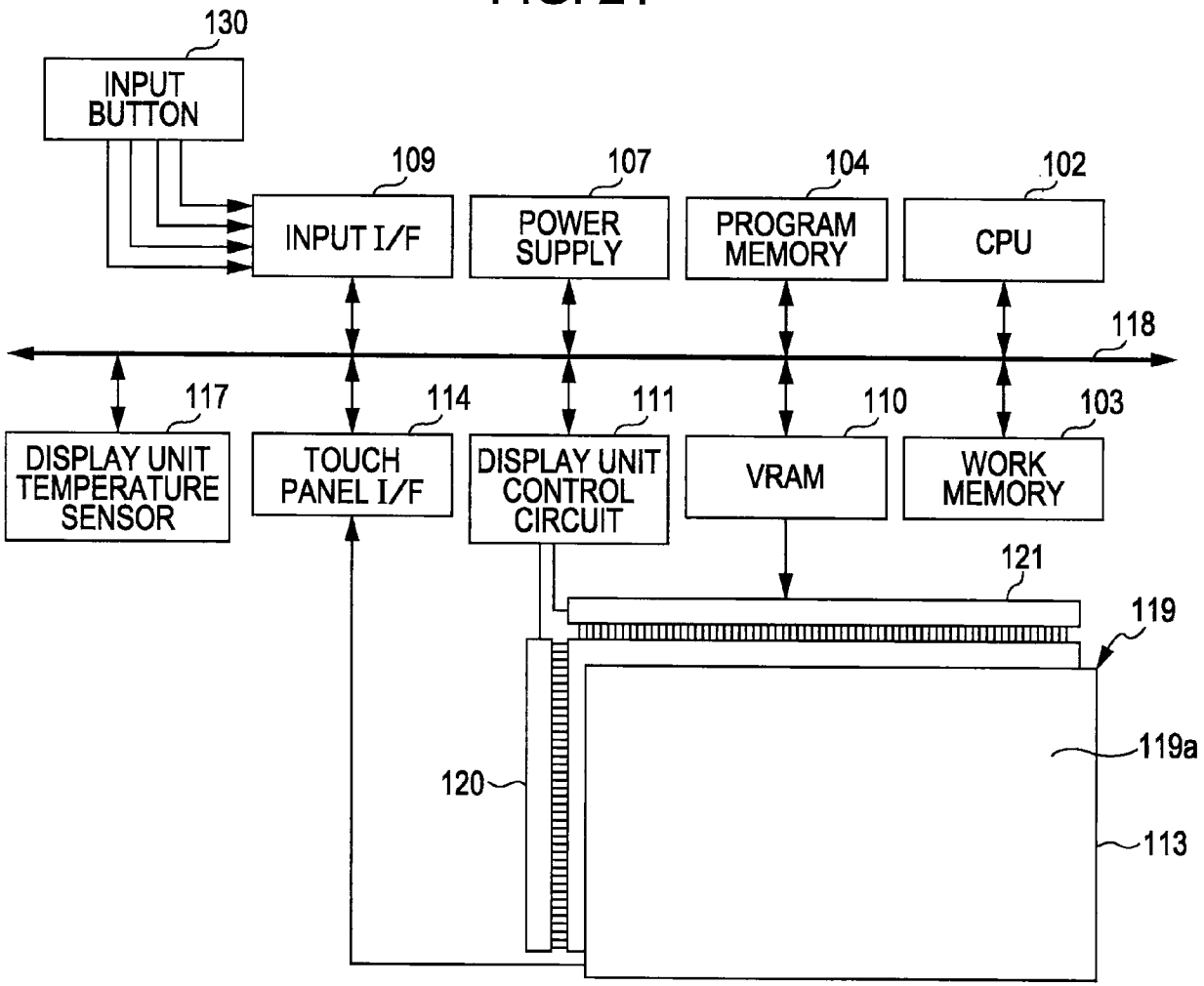
FIG. 21 is a diagram illustrating an internal configuration of the electronic book reader of the third embodiment.

FIG. 20 is an appearance view of an electronic book reader that is an electro-optic device according to an example of the invention, and FIG. 21 is a diagram illustrating an internal configuration of the electronic book reader.

As shown in FIG. 20, the electronic book reader 300 is provided with a case 101, and an electrophoretic display panel 119 provided in a spherical opening portion 101*a* formed on one side of the case 101. The case 101 is provided with a page turning button 105, a page returning button 106, a determination button 108, a skip turning button 115, and a skip returning button 116.

The page turning button 105 is an operation unit having a function of turning to the next page of a document (image) currently displayed on the electrophoretic display panel 119 one at a time and displaying the page whenever the page turning button 105 is pushed once. The page returning button 106 is an operation unit having a function of returning and displaying a page one by one to the previous page of the document whenever pushing the page returning button 106 once.

The skip turning button 115 is an operation unit having a function of displaying a page by, for example, 10 pages whenever pushing the skip turning button 115 once. The skip returning button 116 is an operation unit having a function of displaying a page by, for example, 10 pages whenever pushing the skip returning button 116 once. The number of skipped pages of the skip turning button 115 and the skip returning button 116 may be arbitrarily set.

As shown in FIG. 21, the electronic book reader 300 is provided with a CPU (Central Processing Unit) 102, a work memory (RAM (Random Access Memory)) 103, a program memory (ROM (Read Only Memory)) 104, an input I/F 109, a VRAM (Video RAM) 110, a display unit control circuit (controller) 111, an electrophoretic display panel 119, a touch panel I/F 114, a power supply 107, and a display unit temperature sensor 117, and the units are connected to transmit and receive signals through a buss 118.

The input I/F 109 is connected to an input button 130. The input button 130 includes the page turning button 105, the page returning button 106, the skip turning button 115, and the determination button 108 shown in FIG. 20. The touch panel I/F 114 is connected to a touch panel 113. The display unit control circuit 111 is connected to the scanning line driving circuit 120 and the data line driving circuit 121 which can be provided in the electrophoretic display panel 119.

The CPU 102 reads various programs such as basic control programs and application programs stored in the program memory 104 and data, develops and executes the various programs and the data in a work area provided in the work memory 103, and performs a control of the units of the electronic book reader.

When a page turning signal is output from the input I/F 109, the CPU 102 generates image data (hereinafter, also referred to as raster data) corresponding to the next page of the document displayed on the electrophoretic display panel 119, and stores the raster data in the VRAM 110.

When a page returning signal is output from the input I/F 109, the CPU 102 generates raster data corresponding to the previous page of the document displayed on the electrophoretic display panel 119, and stores the raster data thereof in the VRAM 110. When a continuous turning signal is output from the input I/F 109, the CPU 102 sequentially generates raster data corresponding to the next page and the later pages of the document displayed on the electrophoretic display panel 119, and sequentially stores the raster data in the VRAM 110.

Whenever the input button 130 (any of the page turning button 105, the page returning button 106, the skip turning button 115, and determination button 108) is pushed, the CPU 102 performs a display process of the number of pages which can be displayed, generates raster data of images representing the number of pages (displayable page number) which can be displayed with the currently remaining amount of driving battery, and stores the raster data in the VRAM 110.

When the CPU 102 performs the processes according to various programs, the work memory 103 forms a work area for developing the various programs and forms a memory area for developing data related to the various processes executed by the CPU 102.

A non-volatile memory such as FeRAM (Ferroelectric Random Access Memory) and MRAM (Magnetoresistive Random Access Memory) is used as the work memory 103.

Since the non-volatile memory is used as the work memory 103, power consumption of the work memory 103 consumed for displaying contents of 1 page can be maintained regular irrespective of a browsing time of the contents by a user. Accordingly, the displayable page number can be easily and accurately calculated. In a method using a volatile memory such as a DRAM (Dynamic Random Access Memory) consuming power of the driving battery as the work memory 103, the power consumption of the work memory 103 is changed according to the browsing time of contents, and thus it is difficult to accurately calculate the displayable page number.

The program memory 104 stores a basic control program executed by the CPU 102, various application programs, data related thereto, and the like. The various programs or data are output to the CPU 102, according to a reading request output from the CPU 102. All the various programs and data in the program memory 104 are stored in a format which is readable and executable by the CPU 102.

The input I/F 109 is connected to the page turning button 105 for turning and displaying an image of the next page on the electrophoretic display panel 119, the page returning button 106 for turning and displaying an image of the previous page on the electrophoretic display panel 119, and the skip turning button 115 for sequentially turning and displaying the contents of the next page on the electrophoretic display panel 119, and the determination button 108, as the input button 130. When the page turning button 105 is pushed, the input I/F 109 outputs a page turning signal to the CPU 102. When the page returning button 106 is pushed, the input I/F 109 outputs a page returning signal to the CPU 102, and when the skip turning button 115 is pushed, the input I/F 109 outputs a continuous turning signal to the CPU 102.

The VRAM 110 stores raster data of an image for each page according to the writing request from the CPU 102. The stored raster data are output to the data line driving circuit 121 according to a transmission request output from the display unit control circuit 111. the display unit control circuit 111 generates various control signals for displaying the raster data stored in the VRAM 110 on the electrophoretic display panel 119, and supplies the control signals to the scanning line driving circuit 120 and the data line driving circuit 121.

The electrophoretic display panel 119 has an electrophoretic display panel 119 in which a plurality of pixels is formed in an array, that is, a panel including an electrophoretic element which can store the display content up to that point even when the supply of power is stopped. The electrophoretic display device 119 is provided with a scanning line driving circuit 120 provided along one side edge of a pixel formed area (display area) 119*a*, and a data line driving circuit 121 provided along the other side edge of the pixel formed area 119*a*.

The scanning line driving circuit 120 inputs a selection signal to a plurality of pixels on the basis of the control signal output from the display unit control circuit 111. The data line driving circuit 121 inputs the raster data output from the VRAM 110, to the pixels to which the selection signal is input from the scanning line driving circuit 120, on the basis of the control signal output from the display unit control circuit 111. Accordingly, the image of the page stored in the VRAM 110 can be displayed on the electrophoretic display panel 119.

In the embodiment, the active matrix electrophoretic display panel 119 provided with the scanning line driving circuit 120 and the data line driving circuit 121 is described, but the electrophoretic display panel 119 may be an electrophoretic display panel of a segment driving manner. The driving circuits (common electrode driving circuit, etc.) other than the scanning line driving circuit 120 and the data line driving circuit 121 may be provided, and connected to the display unit control circuit 111.

The touch panel I/F 114 is connected to the touch panel 113 provided on the front side (display face side) of the electrophoretic display device 119. When the touch panel 113 is pushed, a touch panel signal representing an operation position is output to the CPU 102. An arbitrary type may be used as the touch panel 113. That is, a resistive or electrostatic capacitance touch panel may be used.

The display unit temperature sensor 117 detects a temperature of the electrophoretic display panel 119, and outputs the detected temperature to the CPU 102. For example, a thermistor is used as the display unit temperature sensor 117, and the temperature of the electrophoretic display panel 119 is detected by measuring output voltage thereof. The temperature detected by the display unit temperature sensor 117 is used for calculation of the displayable page number.

Figure 22:
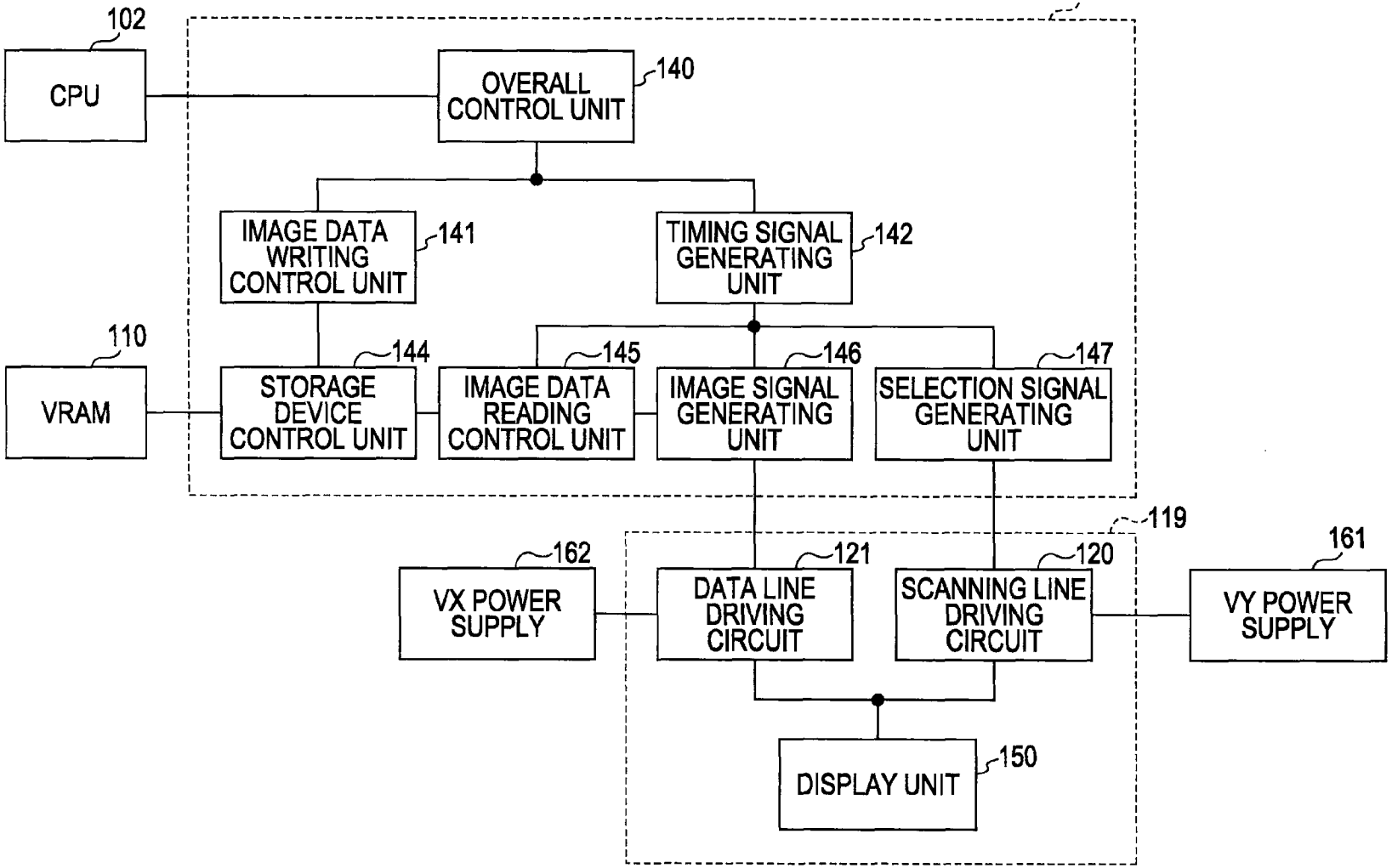
FIG. 22 is a diagram illustrating an internal configuration of a display control circuit in the electronic book reader of the third embodiment.

FIG. 22 is a diagram illustrating an internal configuration of the display unit control circuit.

The display unit control circuit 111 is provided with an overall control unit 140, an image data writing control unit 141, a timing signal generating unit 142, a storage device control unit 144, an image data reading control unit 145, an image signal generating unit 146, and a selection signal generating unit 147, and the display unit control circuit 111 is connected to the electrophoretic display panel 119. The electrophoretic display panel 119 is provided with a display unit 150 having the electrophoretic element, a scanning line driving circuit 120, and a data line driving circuit 121.

The overall control unit 140 is connected to the image data writing control unit 141 and the timing signal generating unit 142. The image data writing control unit 141 is connected to the storage device control unit 144. The timing signal generating unit 142 is connected to the image data reading control unit 145, the image signal generating unit 146, and the selection signal generating unit 147.

In the display unit control circuit 111, the overall control unit 140 is connected to the CPU 102, and the image signal generating unit 146 and the selection signal generating unit 147 are connected to the electrophoretic display panel 119, and the storage device control unit 144 is connected to the VRAM 110.

In the electronic book reader 300 described above, the CPU 102, the work memory 103, the program memory 104, the input I/F 109, the VRAM 110, the display unit control circuit 111, the touch panel I/F 114, the power supply 107, and the display unit temperature sensor 117 are formed on the element substrate on which the scanning line driving circuit 120 and the data line driving circuit 121 constituting the electrophoretic display panel 119, and the circuit elements necessary for displaying the image on the electrophoretic display panel 119 is mounted on one substrate, thereby realizing a device configured on one chip.

In the known configuration, as for the electrophoretic display panel 119, there are many cases where a separate chip or a single unit is configured separately from the scanning line driving circuit 120 and the data line driving circuit 121 which supply the image signals based on the image data, the CPU 102 driving the scanning line driving circuit 120 and the data line driving circuit 121, the display unit control circuit 111, and the like. However, in the embodiment, they are mounted on the same substrate, a plurality of independent chips can be integrated onto one chip, and thus it is possible to realize space saving. By integrating onto one chip, it is possible to drastically reduce a cost and achieve low power consumption, as compared with the known configuration.

Electronic Apparatus

Next, a case of applying the electrophoretic display device 100 according to the embodiments to an electronic apparatus will be described.

Figure 23:
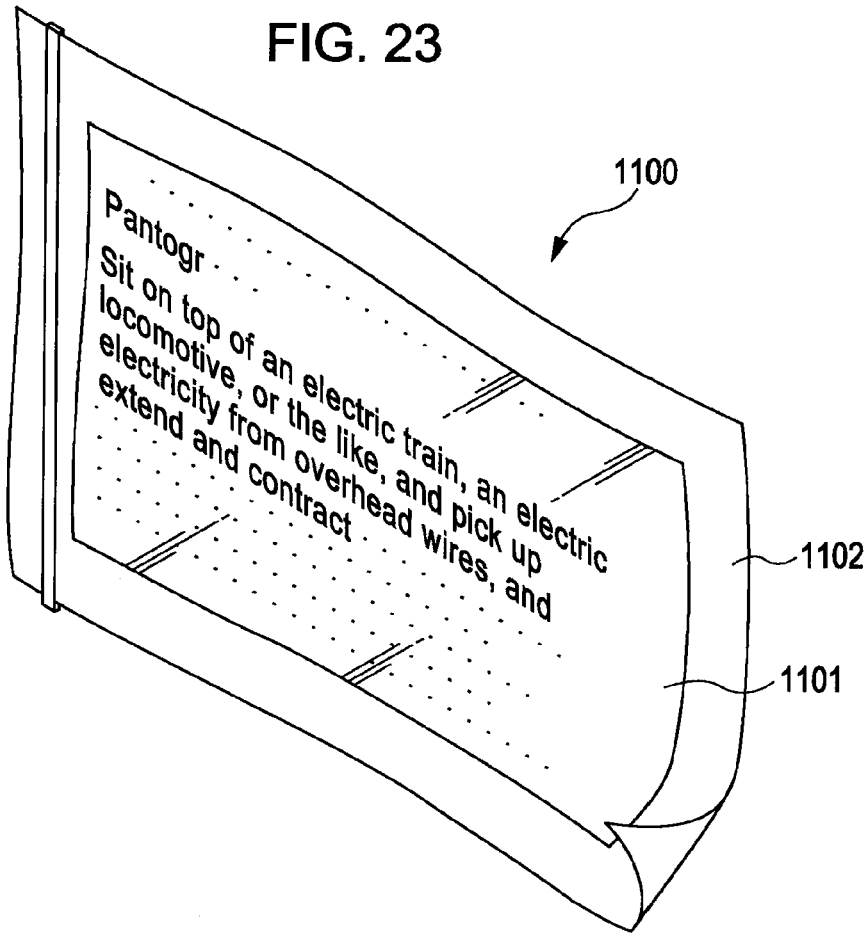
FIG. 23 is a view illustrating an example of an electronic apparatus.

FIG. 23 is a perspective view illustrating a configuration of an electronic paper 1100. The electronic paper 1100 is provided with the electrophoretic display device 100 of the embodiment in a display area 1101. The electronic paper 1100 has flexibility, and is provided with a body 1102 formed of a rewritable sheet with a feel and flexibility like those of existing paper.

Figure 24:
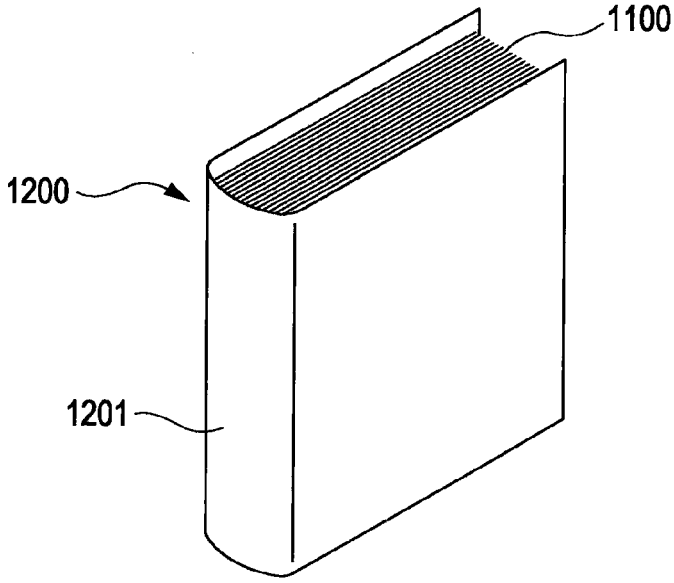
FIG. 24 is a view illustrating an example of an electronic apparatus.

FIG. 24 is a perspective view illustrating a configuration of an electronic notebook 1200. In the electronic notebook 1200, a plurality of sheets of the electronic paper 1100 can be bound, and is put into a cover 1201. The cover 1201 is provided with a data input means (now shown) for inputting display data transmitted from, for example, an external device. With such a configuration, change or update of display contents can be performed with the electronic paper bound, according to the display data.

According to the electronic paper 1100 and the electronic notebook 1200, since the electrophoretic display device according to the invention is employed, there is provided an electronic apparatus provided with optical writing display means configured to easily perform a reset operation with a simple structure.

The above-described electronic apparatus is an example of the electronic apparatus according to the invention, and does not limit the technical scope of the invention. For example, the electrophoretic display device can be very appropriately used for a display unit of an electronic apparatus such as a mobile phone, a portable audio apparatus and the like.

The entire disclosure of Japanese Patent Application Nos: 2009-259844, filed Nov. 13, 2009 and 2010-125917, filed Jun. 1, 2010 are expressly incorporated by reference herein.

What is claimed is:

1. An electrophoretic device for displaying an image data comprising:

a plurality of scanning lines that are arranged in a line direction;

a plurality of data lines that are arranged in a column direction;

a plurality of pixels that are provided at intersection positions of the scanning lines and the data lines, the plurality of pixels including image pixels that display the image data and peripheral pixels that peripherally surround the image pixels that do not display the image data;

a driving circuit that supplies an image signal based on the image data to a display unit formed by arranging the plurality of pixels; and an image data input circuit that inputs the image data to the driving circuit, wherein the image data input circuit includes a storage unit that includes a first line data storage unit, a second line data storage unit, and a third line data storage unit that each store line data of a plurality of continuous lines including line data of an input target among line data formed from pixel data corresponding to one line of the image data, and a data correcting circuit that directly reads the pixel data of the input target with peripheral pixel data thereof from the storage unit and corrects the pixel data of the input target on the basis of quantities of the peripheral pixel data that are different from the pixel data of the input target; and wherein the image pixels and the peripheral pixels are applied a voltage and driven based on the corrected pixel data.

2. The electrophoretic device according to claim 1, wherein the image data are image data for erasing a display image of the display unit, and wherein the data correcting circuit corrects the pixel data of the input target on the basis of a result of a Boolean operation using the peripheral pixel data.

3. An electronic apparatus comprising the electrophoretic device according to claim 2.

4. The electrophoretic device according to claim 1, wherein the image data are image data of displaying a display image including a plurality of gradations on the display unit, and wherein the data correcting circuit corrects gradation values of the pixel data of the input target on the basis of an arithmetic sum of the gradation values of the peripheral pixel data.

5. An electronic apparatus comprising the electrophoretic device according to claim 4.

6. An electronic apparatus comprising the electrophoretic device according to claim 1.

7. The electrophoretic device of claim 1, wherein the data correcting circuit reads the pixel data of the input target from the first line data storage unit with peripheral pixel data thereof from the second and third line data storage units, and corrects the pixel data of the input target on the basis of quantities of the peripheral pixel data that are different from the pixel data of the input target.

8. A method of driving an electrophoretic device for displaying an image data including a display unit formed by arranging a plurality of pixels and a driving circuit supplying an image signal based on the image data to the display unit, the plurality of pixels including image pixels that display the image data and peripheral pixels that peripherally surround the image pixels and do not display the image data, the method comprising:

when inputting the image data formed from pixel data corresponding to the pixels to the driving circuit, correcting the pixel data corresponding to the pixels of an input target received from a first line data storage unit on the basis of quantities of peripheral pixel data that are different from the pixel data of the input target and received from a second line data storage unit and a third line data storage unit;

inputting the corrected pixel data to the driving circuit; and driving the image pixels and the peripheral pixels by applying a voltage to the image pixels and the peripheral pixels based on the corrected pixel data.

9. The method of driving the electrophoretic device according to claim 8, wherein the pixel data of the input target is reversed on the basis of information of the peripheral pixel data of the pixel data.

10. The method of driving the electrophoretic device according to claim 8, wherein the pixel data of the input target is corrected on the basis of a result of a Boolean operation using the peripheral pixel data.

11. The method of driving the electrophoretic device according to claim 10, wherein when a display operation is performed many times using the same image data, the number of writing times to the pixels of the input target is set on the basis of the information of the peripheral data.

12. The method of driving the electrophoretic device according to claim 8, wherein gradation values of the pixel data corresponding to the pixels of the input target are changed on the basis of gradation values of the peripheral pixel data of the pixel data.

13. The method of driving the electrophoretic device according to claim 8, wherein the peripheral pixel data are at least pixel data disposed adjacent to the pixel data of the input target.

* * * * *